US008308257B2

(12) United States Patent
Matsushita et al.

(10) Patent No.: US 8,308,257 B2
(45) Date of Patent: Nov. 13, 2012

(54) LIQUID EJECTING APPARATUS AND METHOD OF MANUFACTURING LIQUID EJECTING APPARATUS

(75) Inventors: Junichiro Matsushita, Matsumoto (JP); Shuji Yonekubo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 12/727,082

(22) Filed: Mar. 18, 2010

(65) Prior Publication Data

US 2010/0238217 A1 Sep. 23, 2010

(30) Foreign Application Priority Data

Mar. 19, 2009 (JP) ..... 2009-068615

(51) Int. Cl.
*B41J 29/38* (2006.01)
*B41J 2/045* (2006.01)

(52) U.S. Cl. ..... 347/10; 347/11; 347/70

(58) Field of Classification Search ..... 347/10, 347/11, 15

See application file for complete search history.

(56) References Cited

U.S. PATENT DOCUMENTS 6,364,444 B1 * 4/2002 Ota ..... 347/10
6,779,866 B2 8/2004 Junhua et al.

FOREIGN PATENT DOCUMENTS

JP 09-039240 2/1997
JP 2001-129992 5/2001
JP 2005-125804 5/2005

* cited by examiner

*Primary Examiner* — Geoffrey Mruk
(74) *Attorney, Agent, or Firm* — Workman Nydegger

(57) ABSTRACT

A liquid ejecting apparatus includes a driving element driven by a driving waveform and a nozzle that ejects liquid. Two first driving waveforms and a second driving waveform are generated in a period to create a driving signal in which the two first and the second driving waveforms are repeatedly generated. When the first driving waveform is applied to the driving element, a first amount of liquid is ejected from the nozzle. When the two first driving waveforms are applied, twice the first amount is ejected. When the second driving waveform is applied, a second amount of liquid larger than the first amount and smaller than twice the first amount is ejected. When the two first driving waveforms and the second driving waveform are applied to the driving element, an amount of liquid smaller than a sum of twice the first amount and the second amount is ejected.

1 Claim, 15 Drawing Sheets

| | | | | | | | SELECTION DATA |
|---|---|---|---|---|---|---|---|
| | MINUTE VIBRATION 0 pl | COM(1) | T11 | T12 | T13 | T14 | q0(0001) |
| | | | × | × | × | ○ | |
| | | COM(2) | T15 | T16 | T17 | | q7(000) |
| | | | × | × | × | | |
| 1 pl | TINY DOT 1.0 pl | COM(1) | T11 | T12 | T13 | T14 | q1(0000) |
| | | | × | × | × | × | |
| | | COM(2) | T15 | T16 | T17 | | q8(001) |
| | | | × | × | ○ | | |
| 0.6 pl | SMALL DOT 1.6 pl | COM(1) | T11 | T12 | T13 | T14 | q2(0100) |
| | | | × | ○ | × | × | |
| | | COM(2) | T15 | T16 | T17 | | q9(000) |
| | | | × | × | × | | |
| 0.9 pl | MIDDLE DOT 2.5 pl | COM(1) | T11 | T12 | T13 | T14 | q3(0000) |
| | | | × | × | × | × | |
| | | COM(2) | T15 | T16 | T17 | | q10(100) |
| | | | ○ | × | × | | |
| 3.5 pl | LARGE DOT 7 pl | COM(1) | T11 | T12 | T13 | T14 | q4(1000) |
| | | | ○ | × | × | × | |
| | | COM(2) | T15 | T16 | T17 | | q11(000) |
| | | | × | × | × | | |
| 7 pl | VERY LARGE DOT 14 pl | COM(1) | T11 | T12 | T13 | T14 | q5(1010) |
| | | | ○ | × | ○ | × | |
| | | COM(2) | T15 | T16 | T17 | | q12(000) |
| | | | × | × | × | | |
| 7 pl | MAXIMUM DOT 21 pl | COM(1) | T11 | T12 | T13 | T14 | q6(1010) |
| | | | ○ | × | ○ | × | |
| | | COM(2) | T15 | T16 | T17 | | q13(010) |
| | | | × | ○ | × | | |

| | | | | | | | SELECTION DATA |
|---|---|---|---|---|---|---|---|
| | MINUTE VIBRATION 0 pl | COM(1) | T11 | T12 | T13 | T14 | q0(0001) |
| | | | × | × | × | ○ | |
| | | COM(2) | T15 | T16 | T17 | | q7(000) |
| | | | × | × | × | | |
| 1 pl | TINY DOT 1.0 pl | COM(1) | T11 | T12 | T13 | T14 | q1(0000) |
| | | | × | × | × | × | |
| | | COM(2) | T15 | T16 | T17 | | q8(001) |
| | | | × | × | ○ | | |
| 0.6 pl | SMALL DOT 1.6 pl | COM(1) | T11 | T12 | T13 | T14 | q2(0100) |
| | | | × | ○ | × | × | |
| | | COM(2) | T15 | T16 | T17 | | q9(000) |
| | | | × | × | × | | |
| 0.9 pl | MIDDLE DOT 2.5 pl | COM(1) | T11 | T12 | T13 | T14 | q3(0000) |
| | | | × | × | × | × | |
| | | COM(2) | T15 | T16 | T17 | | q10(100) |
| | | | ○ | × | × | | |
| 6.5 pl | LARGE DOT 9 pl | COM(1) | T11 | T12 | T13 | T14 | q4(0000) |
| | | | × | × | × | × | |
| | | COM(2) | T15 | T16 | T17 | | q11(010) |
| | | | × | ○ | × | | |
| 5 pl | VERY LARGE DOT 14 pl | COM(1) | T11 | T12 | T13 | T14 | q5(1010) |
| | | | ○ | × | ○ | × | |
| | | COM(2) | T15 | T16 | T17 | | q12(000) |
| | | | × | × | × | | |
| 6 pl | MAXIMUM DOT 20 pl | COM(1) | T11 | T12 | T13 | T14 | q6(1010) |
| | | | ○ | × | ○ | × | |
| | | COM(2) | T15 | T16 | T17 | | q13(010) |
| | | | × | ○ | × | | |

LIQUID EJECTING APPARATUS AND METHOD OF MANUFACTURING LIQUID EJECTING APPARATUS

BACKGROUND

1. Technical Field

The present invention relates to a liquid ejecting apparatus and a method of manufacturing the liquid ejecting apparatus.

2. Related Art

There is known an ink jet printer which ejects ink (liquid) from a nozzle corresponding to a driving element by applying a driving waveform to the driving element. By varying the shape of the driving waveform applied to the driving element, it is possible to vary the amount of ink ejected from the nozzle.

In order to improve the granularity of a print image, it is preferable the kinds of amounts of ink ejected from the nozzle may be made various or the variation in the amount of ink ejected from the nozzle may decrease. There is known an ink jet printer which performs printing by using a driving signal which generates a driving waveform with plural shapes in a repetition period in order to eject the plural kinds of amounts of ink from the nozzle (see JP-A-2005-125804).

When the ink is ejected several times for one pixel from the nozzle in order to form a large dot, plural driving waveforms in a repetition period are applied successively to the driving element. Therefore, when the large dot is formed in a high frequency area, a desired amount of ink can be ejected by applying driving waveforms (hereinafter, referred to as a basic waveform), by which a meniscus after ejection of an ink droplet is easily stabilized, successively to the driving element.

However, when the large dot is formed using the basic waveforms, the amount of ink ejected from the nozzle once by the basic waveforms becomes larger. Moreover, when the number of times by which the basic waveform is applied to the driving element is made different to form dots with other sizes, a variation in the amount of ink ejected from the nozzle becomes larger. For this reason, a problem may arise in that the granularity of an image deteriorates.

SUMMARY

An advantage of some aspects of the invention is that it provides a technique for improving the granularity of an image.

According to an aspect of the invention, there is provided a method of manufacturing a liquid ejecting apparatus which drives a driving element by applying a driving waveform and ejects a liquid from a nozzle corresponding to the driving element. The method includes: preparing data to create a driving signal in which two first driving waveforms and a second driving waveform are generated in a predetermined period and the two first driving waveforms and the second driving waveform are repeatedly generated in each predetermined period; and storing the data prepared to create the driving signal in a memory of the liquid ejecting apparatus. When the first driving waveform is applied to the driving element, a first amount of liquid is ejected from the nozzle. When the two first driving waveforms are applied to the driving element, a double of the first amount of liquid is ejected from the nozzle. When the second driving waveform is applied to the driving element, a second amount of liquid larger than the first amount of liquid and smaller than the double of the first amount of liquid is ejected from the nozzle. When the two first driving waveforms and the second driving waveform are applied to the driving element, an amount of liquid smaller than a sum of the double of the first amount of liquid and the second amount of liquid is ejected from the nozzle.

According to another aspect of the invention, there is provided a liquid ejecting apparatus including: a driving element which is driven by a driving waveform; a nozzle from which a liquid is ejected by driving the driving element; a driving signal generator which creates a driving signal in which the driving waveform is generated; and a controller which permits the driving signal generator to generate two first driving waveforms and a second driving waveform in a predetermined period and to create the driving signal in which the two first driving waveforms and the second driving waveform are repeatedly generated in each predetermined period. When the first driving waveform is applied to the driving element, a first amount of liquid is ejected from the nozzle. When the two first driving waveforms are applied to the driving element, a double of the first amount of liquid is ejected from the nozzle. When the second driving waveform is applied to the driving element, a second amount of liquid larger than the first amount of liquid and smaller than the double of the first amount of liquid is ejected from the nozzle. When the two first driving waveforms and the second driving waveform are applied to the driving element, an amount of liquid smaller than a sum of the double of the first amount of liquid and the second amount of liquid is ejected from the nozzle.

Other aspects of the invention are apparent from the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary of Disclosure

Figure 1A:
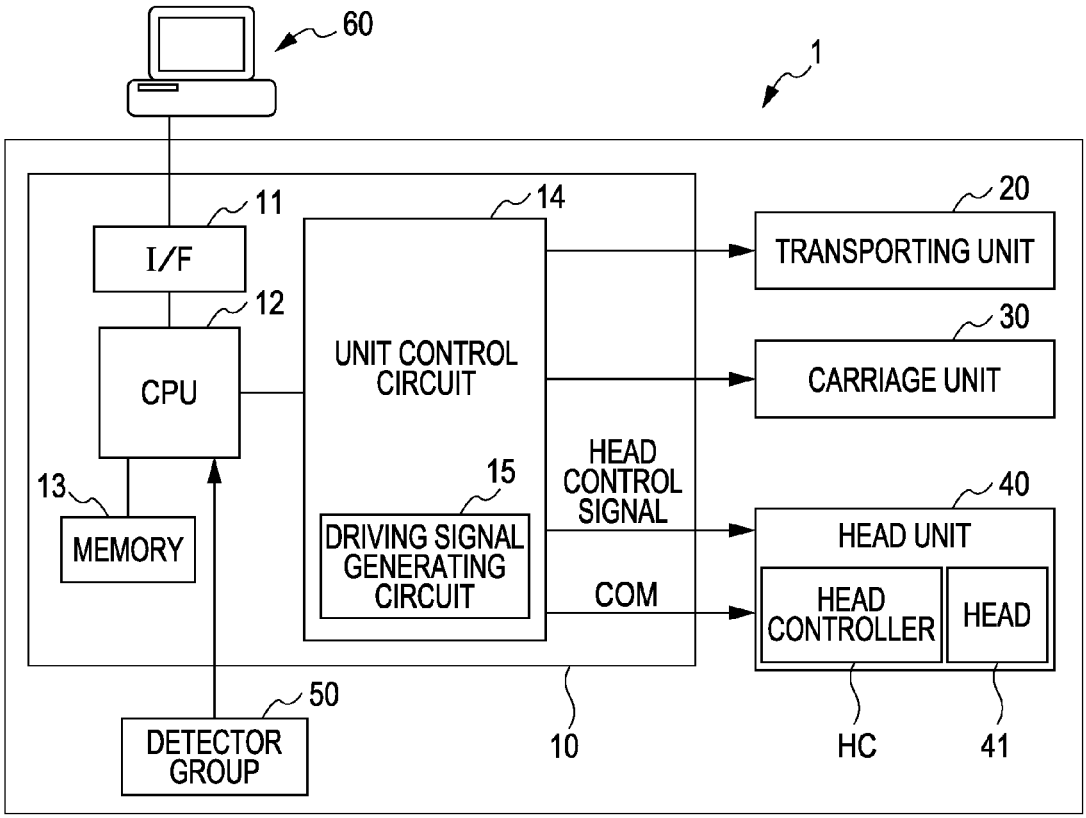
FIG. 1A is a block diagram illustrating the overall configuration of a printer according to an embodiment.

The following aspects are apparent from the description of the specification and the accompanying drawings.

According to an aspect of the invention, there is provided a method of manufacturing a liquid ejecting apparatus which drives a driving element by applying a driving waveform and ejects a liquid from a nozzle corresponding to the driving element. The method includes: preparing data to create a driving signal in which two first driving waveforms and a second driving waveform are generated in a predetermined period and the two first driving waveforms and the second driving waveform are repeatedly generated in each predetermined period; and storing the data prepared to create the driving signal in a memory of the liquid ejecting apparatus. When the first driving waveform is applied to the driving element, a first amount of liquid is ejected from the nozzle. When the two first driving waveforms are applied to the driving element, a double of the first amount of liquid is ejected from the nozzle. When the second driving waveform is applied to the driving element, a second amount of liquid larger than the first amount of liquid and smaller than the double of the first amount of liquid is ejected from the nozzle. When the two first driving waveforms are applied to the driving element, an amount of liquid smaller than a sum of the double of the first amount of liquid and the second amount of liquid is ejected from the nozzle.

According to the method of manufacturing the liquid ejecting apparatus, it is possible to improve the granularity of an image.

In the method of manufacturing the liquid ejecting apparatus, the second driving waveform may be generated between two first driving waveforms in the predetermined period.

According to the method of manufacturing the liquid ejecting apparatus, it is possible to reduce a liquid ejection time.

In the method of manufacturing the liquid ejecting apparatus, a result may be acquired by varying a temporal interval until generation of the first driving waveform being later generated in the predetermined period from generation of the second driving waveform a plural number of times and measuring an amount of liquid ejected from the nozzle by the two first driving waveforms and the second driving waveform. The generation positions of the two first driving waveforms and the second driving waveform may be determined in the predetermined period of the driving signal on the basis of the result.

According to the method of manufacturing the liquid ejecting apparatus, it is possible to design the driving signal configured to eject the desired amount of liquid.

In the method of manufacturing the liquid ejecting apparatus, a result may be acquired by varying a temporal interval until generation of the second driving waveform from generation of the first driving waveform being earlier generated in the predetermined period and a temporal interval until generation of the first driving waveform being later generated in the predetermined period from the second driving waveform a plural number of times and measuring an amount of liquid ejected from the nozzle by the two first driving waveforms and the second driving waveform. The generation positions of the two first driving waveforms and the second driving waveform may be determined in the predetermined period of the driving signal on the basis of the result.

According to the method of manufacturing the liquid ejecting apparatus, it is possible to design the driving signal configured to eject the desired amount of liquid.

In the method of manufacturing the liquid ejecting apparatus, the driving waveform generated by the first driving signal and the driving waveform generated by the second driving signal may be applicable to the same driving element. The two first driving waveforms and the second driving waveform may be generated separately by the first driving signal and the second driving signal.

According to the method of manufacturing the liquid ejecting apparatus, it is possible to disperse an amount of heat generated in a driving signal generator.

In the method of manufacturing the liquid ejecting apparatus, when the two first driving waveforms and the second driving waveform are applied to the driving element, an amount of liquid ejected from the nozzle by the second driving waveform may be smaller than the second amount of liquid.

According to the method of manufacturing the liquid ejecting apparatus, it is possible to eject the desired amount of liquid.

In the method of manufacturing the liquid ejecting apparatus, when the two first driving waveforms and the second driving waveform are applied to the driving element, an amount of liquid ejected from the nozzle by the first driving waveform generated later in the predetermined period may be smaller than the first amount of liquid.

According to the method of manufacturing the liquid ejecting apparatus, it is possible to eject the desired amount of liquid.

According to another aspect of the invention, there is provided a liquid ejecting apparatus including: a driving element which is driven by a driving waveform; a nozzle from which a liquid is ejected by driving the driving element; a driving signal generator which creates a driving signal in which the driving waveform is generated; and a controller which permits the driving signal generator to generate two first driving waveforms and a second driving waveform in a predetermined period and to create the driving signal in which the two first driving waveforms and the second driving waveform are repeatedly generated in each predetermined period. When the first driving waveform is applied to the driving element, a first amount of liquid is ejected from the nozzle. When the two first driving waveforms are applied to the driving element, a double of the first amount of liquid is ejected from the nozzle. When the second driving waveform is applied to the driving element, a second amount of liquid larger than the first amount of liquid and smaller than the double of the first amount of liquid is ejected from the nozzle. When the two first driving waveforms and the second driving waveform are applied to the driving element, an amount of liquid smaller than a sum of the double of the first amount of liquid and the second amount of liquid is ejected from the nozzle.

According to the liquid ejecting apparatus having the configuration, it is possible to improve the granularity of an image.

Ink Jet Printer

Hereinafter, an ink jet printer will be described as an example of a liquid ejecting apparatus, and a serial type printer (hereinafter, referred to as a printer 1) of the ink jet printer will be described.

Figure 1B:
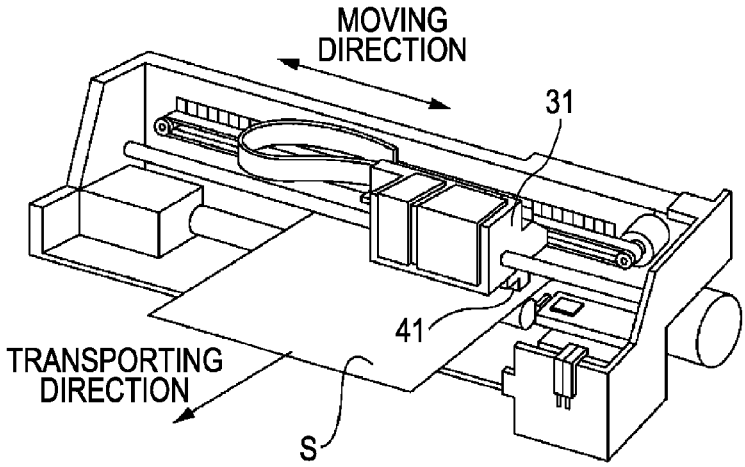
FIG. 1B is a perspective view illustrating a part of the printer.

FIG. 1A is a block diagram illustrating the overall configuration of the printer 1 according to an embodiment. FIG. 1B is a perspective view illustrating a part of the printer 1. In the printer 1 receiving print data from a computer 60 serving as an external apparatus, a controller 10 controls units (a transporting unit 20, a carriage unit 30, and a head unit 40) to form an image on a sheet S (medium). A detector group 50 detects the status of the printer 1. The controller 10 controls the units on the basis of the detection result.

The controller 10 is a unit which controls the printer 1. An interface unit 11 is a unit which transmits and receives data between the computer 60 serving as the external apparatus and the printer 1. A CPU 12 is an arithmetic processing unit which controls the entire printer 1. A memory 13 is a unit which ensures a region for storing the programs of the CPU 12, a working region, or the like. The CPU 12 controls the units by a unit control circuit 14.

The transporting unit 20 is a unit which transports the sheet S to a printable location and transports the sheet S by a predetermined transport amount in a printing direction at print time. The carriage unit 30 is a unit which moves a head 41 mounted on a carriage 31 in a direction (hereinafter, referred to as a moving direction) intersecting the transporting direction of the sheet.

The head unit 40, which ejects ink to the sheet S, includes the head 41 and a head controller HC. A plurality of nozzles serving as an ink ejection unit is formed on the lower surface of the head 41. Ink droplets are ejected from the nozzles corresponding to piezoelectric elements (corresponding to a driving element) which are deformed on the basis of a head control signal from the controller 10 or a driving signal COM generated by a driving signal generating circuit 15.

The printer 1 according to this embodiment forms an image by alternately repeating a dot forming process of intermittently ejecting the ink from the head 41 being moved in the moving direction and forming dots on the sheet S and a transporting process of transporting the sheet S in the transporting direction to form dots at positions different from the positions of the dots formed in the previous dot forming process.

Driving of Head 41

Configuration of Head 41

Figure 2A:
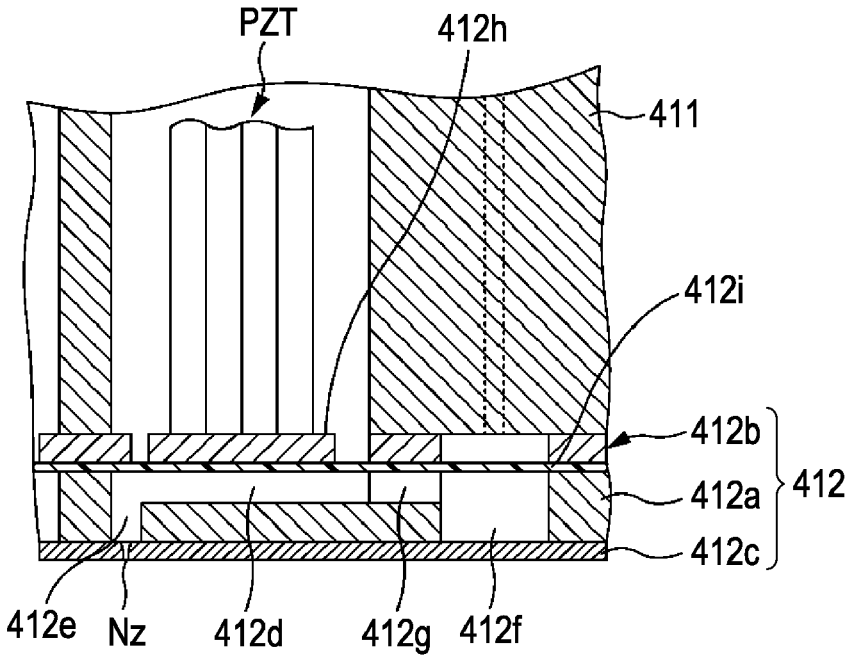
FIG. 2A is a sectional view illustrating a head.

FIG. 2A is a sectional view illustrating the head 41. The main body of the head 41 includes a case 411, a passage unit 412, and a piezoelectric element group PZT. The case 411 accommodates the piezoelectric element group PZT. The passage unit 412 is joined to the lower surface of the case 411.

The passage unit 412 includes a passage forming plate 412*a*, an elastic plate 412*b*, and a nozzle plate 412*c*. The passage forming plate 412*a* has a groove which becomes a pressure chamber 412*d*, a through port which becomes a nozzle communication port 412*e*, a through port which becomes a common ink chamber 412*f*, and a groove which becomes an ink supply passage 412*g*. The elastic plate 412*b* includes an island portion 412*h* to which the front end of the piezoelectric element group PZT is joined. An elastic region by an elastic film 412*i* is formed in the circumference of the island portion 412*h*. The ink stored in an ink cartridge is supplied to the pressure chamber 412*d* corresponding to each nozzle Nz via the common ink chamber 412*f*. The nozzles Nz ejecting the ink are formed in the nozzle plate 412*c*.

Figure 2B:
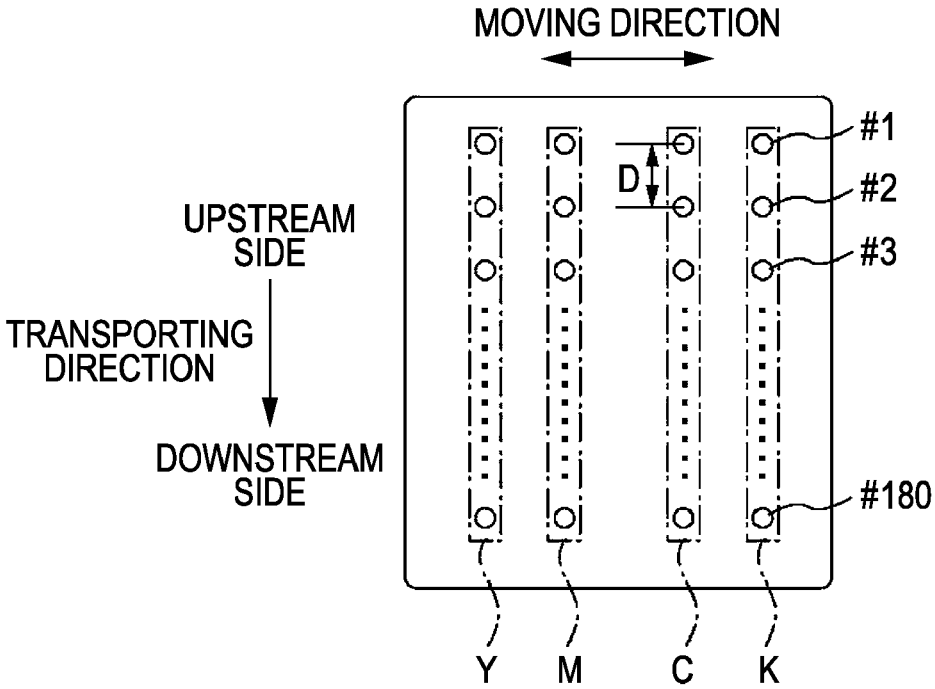
FIG. 2B is a diagram illustrating a nozzle surface of the head.

FIG. 2B is a diagram illustrating a nozzle surface of the head 41. Four nozzle rows in which 180 nozzles are arranged at a predetermined interval D in the transporting direction are formed on the nozzle surface. Ink of different colors is ejected from the nozzle rows. The four nozzle rows include a yellow nozzle row Y ejecting yellow ink, a magenta nozzle row M ejecting magenta ink, a cyan nozzle row C ejecting cyan ink, and a black nozzle row K ejecting black ink.

The piezoelectric element group PZT has plural pectinate piezoelectric elements (driving element) of which the number corresponds to the number of the nozzles Nz. The piezoelectric element group PZT vertically contracts or expands in accordance with the potential of the driving signal COM by wiring board (not shown) mounted with the head controller HC, when the driving signal COM is applied to the piezoelectric element group PZT (hereinafter, referred to as a piezoelectric element). When the piezoelectric element group PZT contracts, the island portion 412*h* is pushed toward the pressure chamber 412*d* or pulled toward an opposite direction of the pressure chamber 412*d*. At this time, the elastic film 412*i* in the circumference of the island portion 412*h* is deformed and the pressure in the pressure chamber 412*d* increases or decreases to eject the ink droplets from the nozzles.

Driving Signal Generating Circuit

Figure 3:
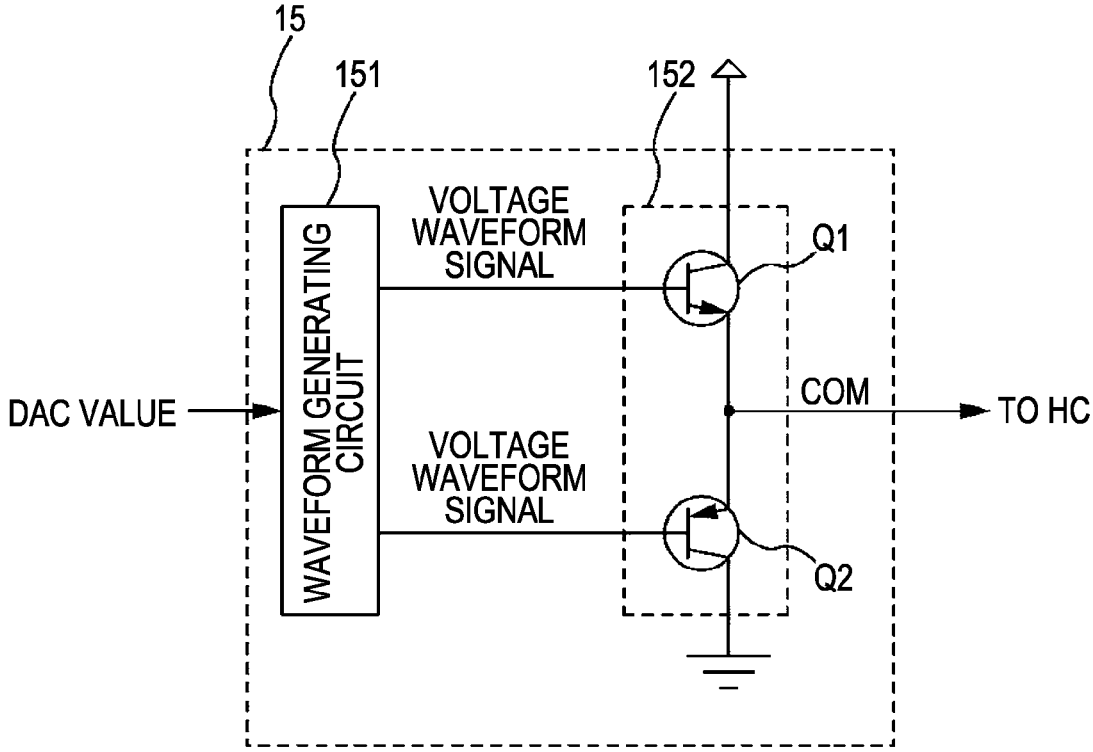
FIG. 3 is a diagram illustrating a driving signal generating circuit generating a driving signal.

FIG. 3 is a diagram illustrating the driving signal generating circuit 15 (corresponding to a driving signal generating unit) which generates the driving signal COM. The driving signal generating circuit 15 includes a waveform generating circuit 151 and a current amplifying circuit 152. The waveform generating circuit 151 generates a voltage waveform signal (waveform information of an analog signal), which is a base of the driving signal COM, on the basis of a DAC value (waveform information of a digital signal). The current amplifying circuit 152 amplifies the current of the voltage waveform signal and outputs the current of the voltage waveform signal as the driving signal COM. The driving signal COM is commonly used to eject the ink from the nozzles belonging to a certain nozzle row (nozzle row). The invention is not limited to a DAC circuit (digital circuit), but an analog circuit may be used.

The current amplifying circuit 152 includes an increasing transistor Q1 (NPN-type transistor) operating when the voltage of the driving signal COM increases and a decreasing transistor Q2 (PNP-type transistor) operating when the voltage of the driving signal COM decreases. In the increasing transistor Q1, a collector is connected to a power source and an emitter is connected to an output signal line of the driving signal COM. In the decreasing transistor Q2, a collector is connected to a ground wire and an emitter is connected to the output signal line of the driving signal COM.

When the increasing transistor Q1 turns on by the voltage waveform signal from the waveform generating circuit 151, the driving signal COM increases to charge the piezoelectric element PZT. On the other hand, when the decreasing transistor Q2 turns on by the voltage waveform signal, the driving signal COM decreases to charge the piezoelectric element PZT. In this way, the driving signal is generated to eject the ink droplets from the nozzles.

Head Controller HC

Figure 4:
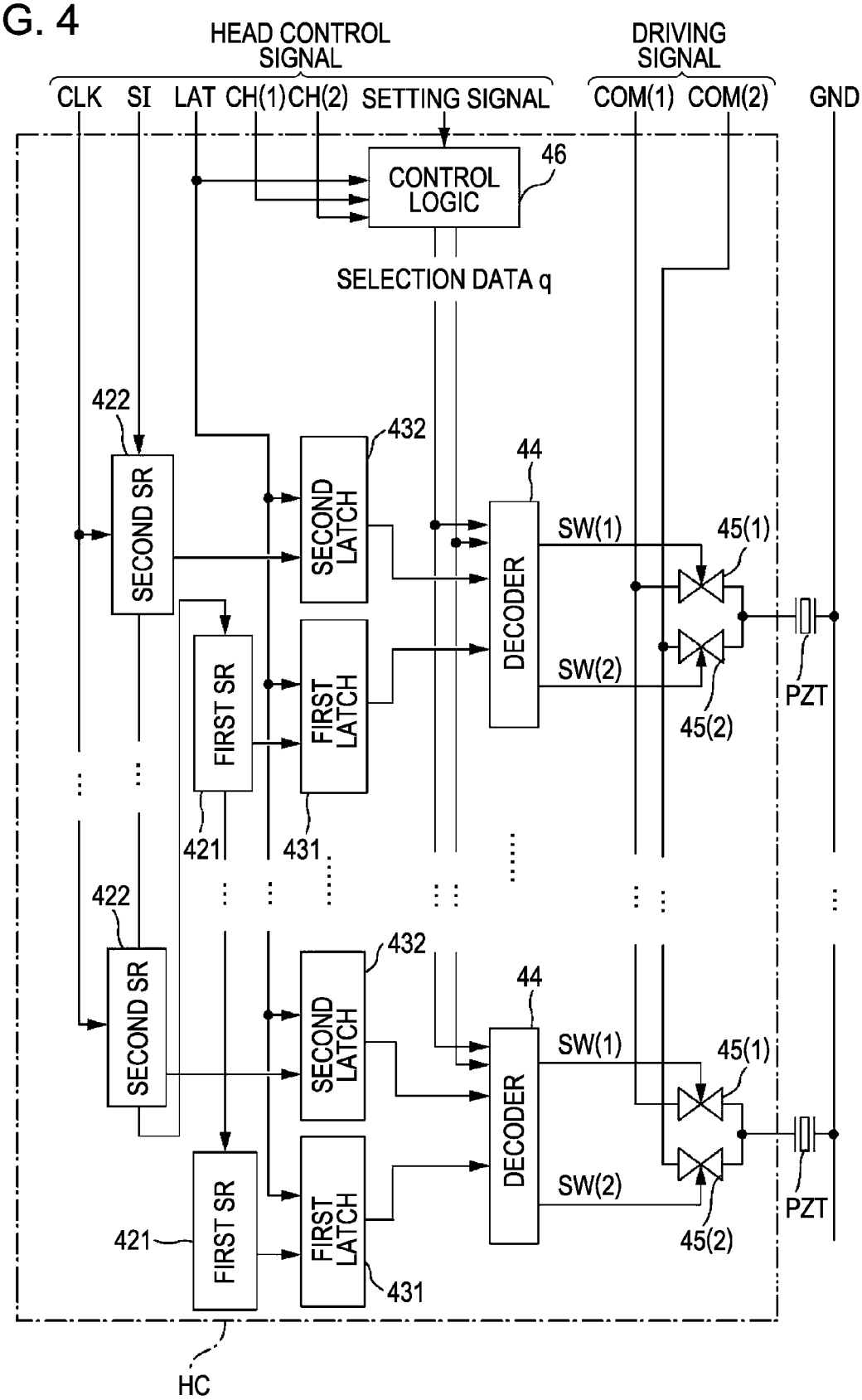
FIG. 4 is a diagram illustrating a head controller.

FIG. 4 is a diagram illustrating the head controller HC. In the head controller HC, each piezoelectric element (group)

PZT includes a first shift register 421, a second shift register 422, a first latch circuit 431, a second latch circuit 432, a decoder 44, a first switch 45(1), a second switch 45(2), and a control logic 46.

For easy description, it is assumed that, for example, 2-bit dot formation data SI is sent from the controller 10 to the head controller HC in one pixel (which is a unit region set imaginarily on a sheet). In the embodiment described below, since there are many kinds of dots formed in one pixel, the number of dot forming data SI correspondingly increases. The upper bit of the dot formation data SI is set in the first shift register 421 and the lower bit of the dot formation data SI is set in the second shift register 422. At time defined in a latch signal LAT, the first latch circuit 431 latches the data set in the first shift register 421 and the second latch circuit 432 latches the data set in the second shift register 422. The dot formation data SI transmitted in serial form are paired with each nozzle Nz by latching the data by the first latch circuit 431 and the second latch circuit 432. The decoder 44 performs decoding on the basis of the dot formation data SI from the first latch circuit 431 and the second latch circuit 432 and outputs switch control signals SW(1) and SW(2) to control the first switch 45(1) and the second switch 45(2), respectively. The switch control signals SW are selected from plural kinds of selection data q (which are described below) output from the control logic 46. Here, two driving signals COM(1) and COM(2) (which are described below) are input to one head controller HC. The first switch 45(1) controls the application of the first driving signal COM(1) to the piezoelectric element on the basis of the first switch control signal SW(1). The second switch 45(2) controls the application of the second driving signal COM(2) to the piezoelectric element on the basis of the second switch control signal SW(2).

Driving Signal COM According to Comparative Example

Figure 5:
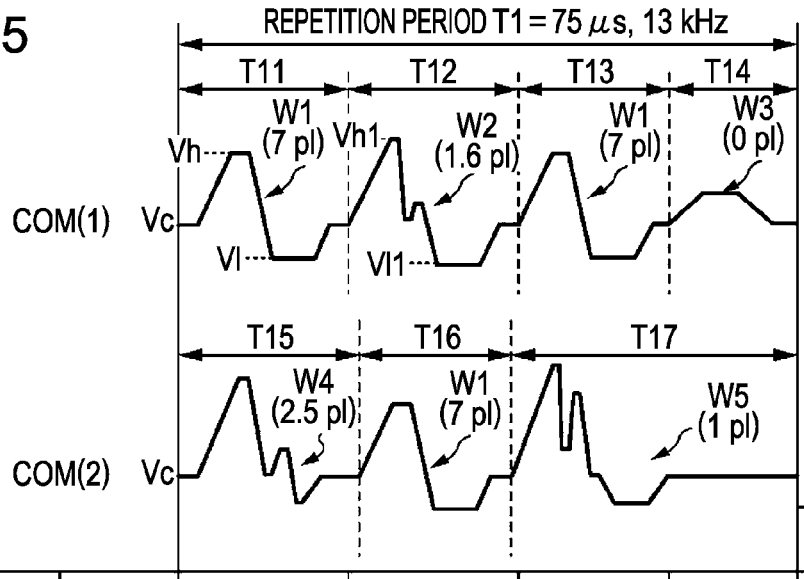
FIG. 5 is a diagram illustrating first and second driving signals according to a comparative example.

FIG. 5 is a diagram illustrating the first driving signal COM(1) and the second driving signal COM(2) according to a comparative example. According to the comparative example, six kinds of amounts of ink are ejected from one nozzle to form six kinds of dots for one pixel. The six kinds of dots include a tiny dot (1 pl), a small dot (1.6 pl), a middle dot (2.5 pl), a large dot (7 pl), a very large dot (14 pl), and a maximum dot (21 pl). That is, according to the comparative example, seven gray scales can be expressed for one pixel, including a case where no dot is formed.

In order to make the amount of ink ejected from the nozzle with the same size, the shape of the driving waveform W of the driving signal COM may be made different. However, when the number of driving waveforms W increases with the increase in the kinds of amounts of ink ejected from the nozzle, a period (hereinafter, referred to as a repetition period T) in which the driving waveform W is generated becomes longer. The repetition period T corresponds a time at which one nozzle faces one pixel. Therefore, a print time becomes longer, when the repetition period T is longer.

Here, when the plural driving waveforms W are generated separately in a first driving signal COM(1) and a second driving signal COM(2), the length of the repetition period T can be shortened. In order to do so, two driving signal generating circuits 15 shown in FIG. 3 are provided for each nozzle row, so that one driving signal generating circuit 15 generates the first driving signal COM(1) and the other driving signal generating circuit 15 generates the second driving signal COM(2). As shown in FIG. 4, the two driving signals COM(1) and COM(2) are input to the head controller HC of a certain nozzle row.

Hereinafter, the first driving signal COM(1) and the second driving signal COM(2) used in the comparative example will be described. FIG. 5 shows the first driving signal COM(1). In a repetition period T1, a first waveform W1 is generated for a period T11, a second waveform W2 is generated for a period T12, the first waveform W1 is again generated for a period T13, and a third waveform W3 is generated for a period T14. On the other hand, in the second driving signal COM(2), a fourth waveform W4 is generated for a period T15, a first waveform W1 is generated for a period T16, and the fifth waveform W5 is generated for a period T17.

Here, when the first waveform W1 is applied to the piezoelectric element, ink of 7 pl is ejected from the nozzle corresponding to this piezoelectric element. When the second waveform W2 is applied to the piezoelectric element, ink of 1.6 pl is ejected from the nozzle corresponding to this piezoelectric element. When the fourth waveform W4 is applied to the piezoelectric element, ink of 2.5 pl is ejected from the nozzle corresponding to this piezoelectric element. When the fifth waveform W5 is applied to the piezoelectric element, ink of 1 pl is ejected from the nozzle corresponding to this piezoelectric element.

However, even when the third waveform W3 is applied to the piezoelectric element, no ink droplet is ejected from the nozzle corresponding to this piezoelectric element and the meniscus (which is a free surface of the ink being exposed from the nozzle) of this nozzle minutely vibrates. For example, when the dot formation data SI corresponding to a certain pixel indicates "no dot", the third waveform W3 is applied to the piezoelectric element of the nozzle allocated to the pixel. By doing so, the meniscus of the nozzle minutely vibrates, but the ink droplet is not ejected from the nozzle and no dot is thus formed in this pixel. In this way, even when the ink droplet is not ejected from the nozzle, the dryness of the meniscus can be prevented by minutely vibrating the meniscus of the nozzle. Therefore, the ink ejection can be prevented from failing due to clogging of the nozzle.

When the dot formation data SI indicates "no dot", selection data q0 corresponding to the first driving signal COM(1) is expressed by "0001" and selection data q7 corresponding to the second driving signal COM(2) is expressed by "000".

Hereinafter, selection data q0 to q13 will be described. The selection data q0 to q13 are output from the control logic 46 shown in FIG. 4. The selection data selected from the plural selection data q0 to q13 on the basis of the dot formation signal SI correspond to the switch control signals SW(1) and SW(2). The selection data q0 to q6 represent the selection patterns of the driving waveforms (W1, W2, and W3) of the first driving signal COM(1). The selection data q7 to q13 represent the selection patterns of the driving waveforms (W1, W4, and W5) of the second driving signal COM(2).

Since the first driving signal COM(1) has four driving waveforms and the repetition period T1 is divided into four periods (T11 to T14), the selection data q0 to q6 are expressed by four bits. Since the second driving signal COM(2) has three driving waveforms W and the repetition period T1 is divided into three periods (T15 to T17), the selection data q7 to q13 are expressed by three bits. The detail (whether a driving waveform is applied) of the selection data q0 to q13 is switched at conversion time of each period (T11 to T17). When the selection data is "0", the driving waveform corresponding to this period is not applied to the piezoelectric element. When the selection data is "1", the driving waveform corresponding to this period is not applied to the piezoelectric element.

When the dot formation data SI indicates "tiny dot formation", the selection data q1 of the first driving signal COM(1) is expressed by "0000" and the selection data q8 of the second driving signal COM(2) is expressed by "001". Therefore, the fifth waveform W5 is applied to the corresponding piezoelectric element. By doing so, the ink of 1 pl corresponding to the tiny dot is ejected from the nozzle. Likewise, when the dot formation data SI indicates "small dot formation", the second waveform W2 is applied to the corresponding piezoelectric element and the ink of 1.6 pl is ejected from the nozzle. When the dot formation data SI indicates "middle dot formation", the fourth waveform W4 is applied to the corresponding piezoelectric element and the ink of 2.5 pl is ejected from the nozzle. When the dot formation data SI indicates "large dot formation", the first waveform W1 is applied to the corresponding piezoelectric element and the ink of 7 pl is ejected from the nozzle. When the dot formation data SI indicates "very large dot formation", the two first waveforms W1 are applied to the corresponding piezoelectric element and the ink of 14 pl is ejected from the nozzle. When the dot formation data SI indicates "maximum dot formation", the three first waveforms W1 are applied to the corresponding piezoelectric element and the ink of 21 pl is ejected from the nozzle.

That is, as for the tiny dot, the small dot, the middle dot, and the large dot, the amount of ink ejected from the nozzle is made different by changing the shape of the driving waveform W applied to the piezoelectric element. As for the large dot, the very large dot, and the maximum dot, the amount of ink ejected from the nozzle is made different by changing the number of driving waveforms (the first waveforms W1) applied to the piezoelectric element.

The amount of ink which can be ejected from the nozzle forming the tiny dot once is restrictive. Here, when the maximum dot is formed, the ink is ejected from the nozzles twice. That is, in order to form the maximum dot, the driving waveforms (here, the first waveforms W1) are applied successively to the piezoelectric element for the period of the same repetition period T. Therefore, the driving waveform applied successively to the piezoelectric element is set as a driving waveform in which the meniscus after the ink ejection becomes stable easily and which a large amount of ink is ejected from the nozzle to form the maximum dot.

The very large dot is formed in printing (so-called solid printing) of forming an image in a predetermined region on the sheet, since the largest amount of ink ejected for one pixel is used for the maximum dot. In terms of high speed printing, it is important to perform the solid printing at a high speed. For this reason, the driving waveform used to eject the relatively large amount of ink from the nozzle once in the repetition period T is set so that the meniscus after the ink ejection becomes stable easily and the driving waveform can be used even in a high frequency area. That is, the driving waveform may be designed so that the stable amount of ink can be obtained and the repetition period T is shortened as small as possible even when the driving waveform used to eject the large amount of ink is applied twice for the repetition period T in order to perform the solid printing at a high speed.

Hereinafter, the driving waveform (here, the first waveform W1) configured so that the relatively large amount of ink is ejected from one nozzle once in the repetition period T and configured so that the meniscus after the ink ejection becomes stable easily is referred to as "a basic waveform".

The first waveform W1 serving as the basic waveform first increases from a middle potential Vc to the highest potential Vh, as shown in FIG. 5. Accordingly, the piezoelectric element PZT shown in FIGS. 2A and 2B contracts in its longitudinal direction and the pressure chamber 412*d* filled with the ink expands. After the expansion state of the pressure chamber 412*d* is maintained for a while, the potential decreases from the highest potential Vh to the lowest potential Vl at once. Accordingly, the piezoelectric element PZT expands in its longitudinal direction and the pressure chamber 412*d* contracts to eject an ink droplet from the nozzle.

However, the second waveform W2, the fourth waveform W4, and the fifth waveform W5 configured to eject an amount of ink smaller than the amount of ink (7 pl) ejected by the first waveform W1 is more complex than the first waveform W1. For example, as shown in FIG. 5, the second waveform W2 increases from the middle potential Vc to the highest potential Vh1, and then does not decrease to the lowest potential Vl1 at once. Instead, the potential decreases from the highest potential Vh1 to the middle potential, increases again, and then decreases to the lowest potential Vl1. In this way, when the ink pillar (meniscus) flying from the nozzle upon first decrease in the potential can be cut small, a small amount of ink can be ejected.

Since the waveform shape of the basic waveform (the first waveform W1) is not more complex than that of the different waveforms (the second waveform W2, the fourth waveform W4, and the fifth waveform W5), residual vibration of the meniscus after the ink ejection by the basic waveform is smaller than the residual vibration of the meniscus after the ink ejection by the other waveforms. Moreover, the residual vibration can be suppressed easily in a relatively short temporal interval. Accordingly, the plural basic waveforms (the first waveforms W1) can be applied repeatedly to the piezoelectric element at a relatively short temporal interval for the repetition period T. On the contrary, when the waveforms different from the basic waveform are applied repeatedly to the piezoelectric element for the repetition period T, the other driving waveforms are applied to the piezoelectric element for a period during which the residual vibration of the meniscus by the previous ink ejection is not stable. Therefore, an appropriate amount of ink may not be ejected.

Accordingly, when a dot larger than a dot (a dot of 7 pl) formed by one basic waveform is formed, it is necessary to apply the plural basic waveforms (the first waveforms W1) to the piezoelectric element, as in the case where the very large dot (14 pl) or the maximum dot (21 pl) is formed.

For this reason, the six kinds of dots are formed in the comparative example. However, as shown in FIG. 5, a difference (7 pl) between the amount of ink used to form the large dot and the amount of ink used to form the very large dot and a difference (7 pl) between the amount of ink used to form the very large dot and the amount of ink used to form the maximum dot may be larger than a difference between the amounts of ink used to form the other dots (for example, a difference between the amount of ink used to form the small dot and the amount of ink used to form the middle dot is 0.9 pl). That is, the amounts of ink used to form the tiny dot to the very large dot increase gradually, but there are more numerous methods (ink variation amount) of increasing the amount of ink used to form the large dot to the very large dot and the very large dot to the maximum dot than a method of increasing the amount of ink used to form another small dot to a next larger sized dot. That is, according to the comparative example, the size of the maximum dot sharply increases from the large dot to the very large dot, whereas the dot size gradually increases from the tiny dot to the large dot.

In order to improve the granularity of the print image, a method may be used such that the kinds (dot sizes) of amounts of ink ejected from the nozzle increase and the ink variation amount (difference between the amounts of ink used to form the respective dots) is made small. According to the comparative example, the ink variation amount "7 pl" between the amounts of ink used to form the dots larger than the large dot is larger than the ink variation amount (for example, 1 pl or 3.5 pl) used to form the dots smaller than the large dot. For this reason, the granularity may deteriorate in the density changed from the large dot to the maximum dot and the density changed from the very large dot to the maximum dot.

In this embodiment, the difference in the amounts of ink used to form the respective dots, that is, the ink variation amount used to form the next larger dot is aimed to be made as small as possible to improve the granularity of the print image. Specifically, a difference between the amount of ink (7 pl) of the large dot formed by one basic waveform (the first waveform W1) and the amount of ink (14 pl) of the very large dot formed by the two basic waveforms (the first waveforms W1) is aimed to be made small and a difference between the amount of ink (14 pl) of the very large dot and the amount of ink (21 pl) of the maximum dot is aimed to be made small to improve the granularity of the print image.

Relationship Between Waveform Interval and Ejection Amount of Ink

Figure 6A:
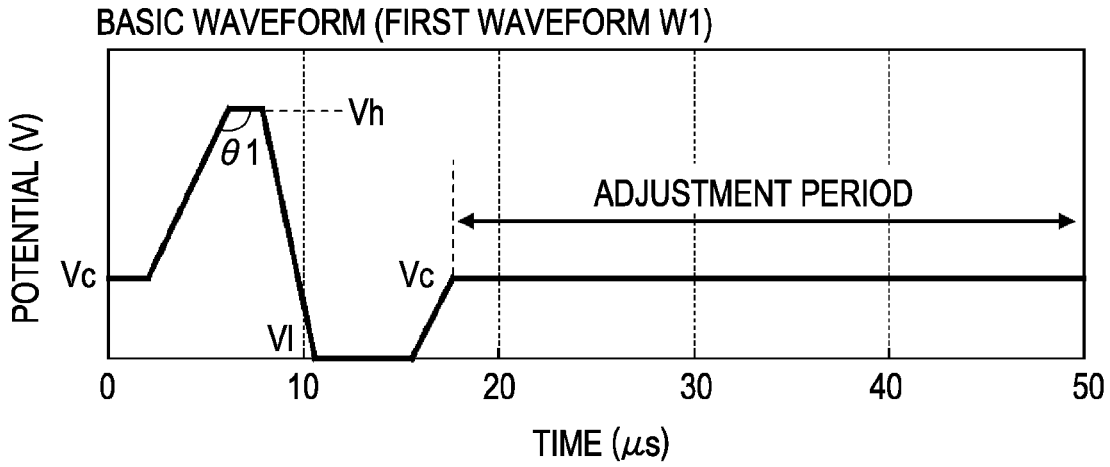
FIG. 6A is a diagram illustrating a basic waveform.
Figure 6B:
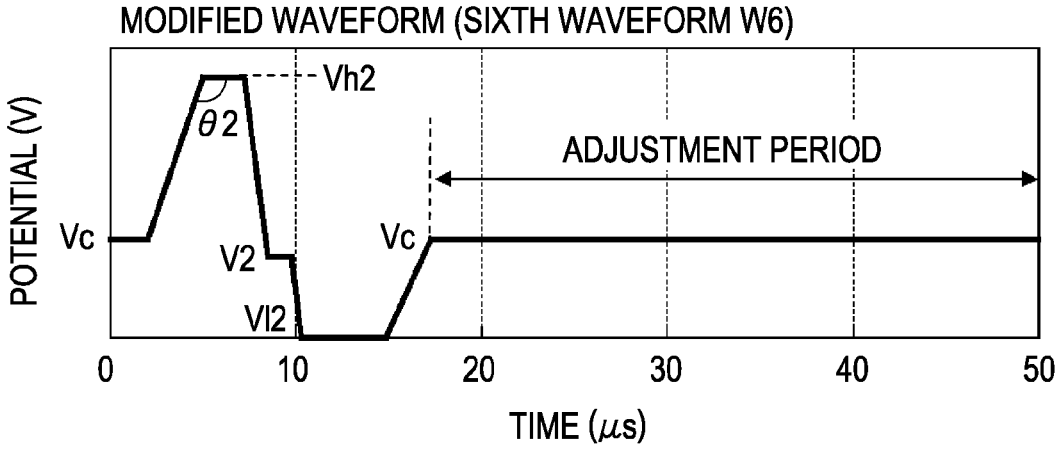
FIG. 6B is a diagram illustrating a modified waveform.

FIG. 6A is a diagram illustrating the basic waveform in which the meniscus after the ink ejection becomes stable easily. FIG. 6B is a diagram illustrating an example of a driving waveform configured to eject an amount of ink slightly different from the amount of ink ejected by the basic waveform. In the drawings, the horizontal axis represents time (μs) and the vertical axis represents a potential variation (V). It is assumed that the ink of 10 pl is ejected from the nozzle by the basic waveform shown in FIG. 6A and the ink of 7 pl is ejected from the nozzle by a modified waveform shown in FIG. 6B. Here, the basic waveform W1 in FIG. 6A has the same shape as that of the basic waveform W1 of the driving signal COM according to the comparative example. Since the sizes of the nozzles ejecting the ink are different from each other, the ejection amounts of ink are different from each other.

As described above, in the basic waveform (FIG. 6A), the potential increases at a slope θ1 from the middle potential Vc to the highest potential Vh. Accordingly, the piezoelectric element shown in FIGS. 2A and 2B contracts in the longitudinal direction, and thus the pressure chamber 412*d* filled with the ink expands. Then, the meniscus 70 is considerably drawn toward the pressure chamber 412*d*. Subsequently, in the basic waveform, the potential decreases from the highest potential Vh to the lowest potential Vl at once, the piezoelectric element expands in the longitudinal direction, and thus the pressure chamber 412*d* contracts. Then, the meniscus 70 drawn in the pressure chamber direction is pushed out in the ejection direction, the ink pillar extruding from the nozzle Nz is separated, and thus the ink droplet is ejected. After the ink droplet ejection, the potential increases from the lowest potential Vl to the middle potential Vc after a predetermined period expires.

On the other hand, in the modified waveform (FIG. 6B) of the basic waveform, the potential increases at a slope θ2 from the middle potential Vc to the highest potential Vh2. Then, the pressure chamber 412*d* expands and the meniscus 70 is drawn in the pressure chamber direction. At this time, the slope angle of the potential is larger in the modified waveform than in the basic waveform (where θ2<θ1). Moreover, in the modified waveform, the potential does not decrease from the highest potential Vh2 to the lowest potential Vl2 at once, but the potential decreases from the highest potential Vh2 to a middle potential V2. In this way, the ink pillar pushed out from the nozzle Nz is not cut at once, but the amount of ink cut from the ink pillar can be adjusted for a maintenance period of the potential V2 so as to be small. After the ink droplet ejection, the potential increases from the lowest potential Vl2 to the middle potential Vc after a predetermined period expires. In this way, as for the modified waveform by which the amount of ink different from the amount of ink ejected by the basic waveform is ejected, since the slope θ2 is sharp upon increasing the potential to the highest potential Vh and the waveform shape is more complex than that of the basic waveform, it is difficult to suppress the meniscus after the ink droplet ejection.

Figure 7:
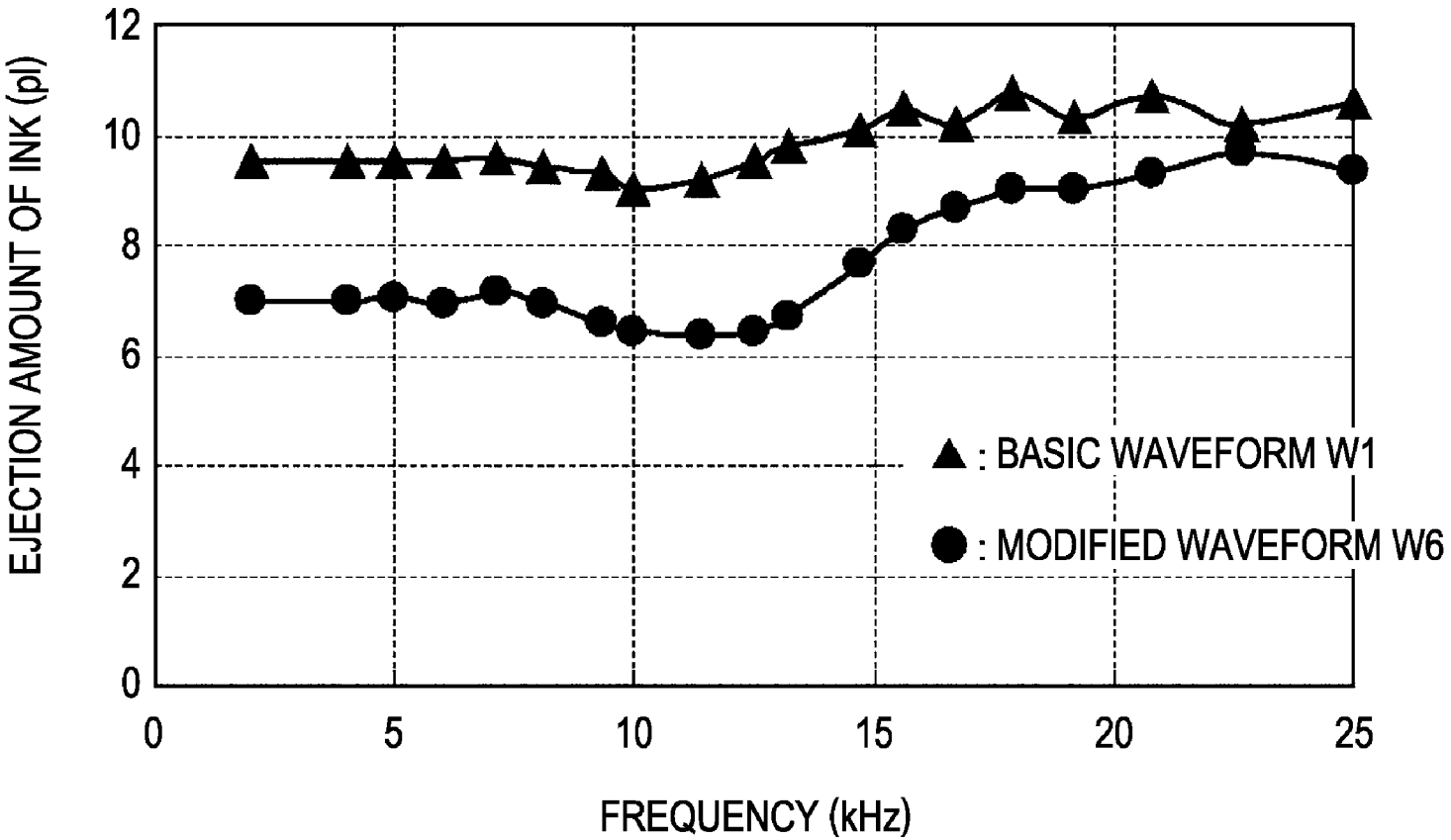
FIG. 7 is a diagram illustrating a measurement result of an ejection amount of ink when a maintenance period of a middle potential is varied.

FIG. 7 is a diagram illustrating a measurement result in which the meniscus after the ink ejection rarely becomes stable by the modified waveform than by the basic waveform. FIG. 7 is the diagram illustrating the measurement result of the ejection amount of ink when the basic waveform and the modified waveform are generated by varying the maintenance period (the adjustment period in FIGS. 6A and 6B) of the middle potential Vc after the ink ejection. By adjusting the maintenance period (hereinafter, referred to as an adjustment period) of the middle potential Vc in each driving waveform, the repetition period T is varied and thus the frequency of each driving waveform is varied. By lengthening the adjustment period of the driving waveform, the repetition period T becomes longer and the frequency of the driving waveform thus becomes lower. In contrast, by shortening the adjustment period of the driving waveform, the repetition period T becomes shorter and the frequency of the driving waveform thus becomes higher.

In FIG. 7, the horizontal axis represents the frequency (kHz) of each driving waveform and the vertical axis represents the ejection amount of ink (pl). The ejection amount of ink in FIG. 7 is an amount of ink ejected from the nozzle once by each driving waveform. The amount of ink ejected from the nozzle after a second time by generating the basic waveforms repeatedly at a predetermined frequency is indicated by a triangle (▲) in the drawing. The amount of ink ejected from the nozzle after a second time by generating the modified waveforms repeatedly at a predetermined frequency is indicated a circle (●) in the drawing.

For example, an ejection amount of ink corresponding to a frequency of 20 kHz refers to an ejection amount of ink when the driving waveform is repeatedly generated at the frequency of 20 kHz and refers to a measurement result of the ejection amount of ink when the length of the repetition period in which one driving waveform is generated is set to 50 μs including the adjustment period. Likewise, an ejection amount of ink corresponding to a frequency of 10 kHz refers to a measurement result of the ejection amount of ink when the length of the repetition period in which one driving waveform is generated is set to 100 μs.

From the measurement result of FIG. 7, it can be known that when the frequencies of the driving waveforms (the basic waveform and the modified waveform) are set to "10 kHz", that is, when the adjustment period (generation interval of the driving waveform) is relatively long, the ink of about 10 pl is ejected from the nozzle by the basic waveform and the ink of about 7 pl is ejected from the nozzle by the modified waveform. That is, the target amount of ink is ejected. When the frequencies of the driving waveforms are set to "20 kHz", that is, when the adjustment period is relatively short, the ink of about 10 pl is ejected from the nozzle by the basic waveform, but the ink of about 9 pl larger than the target amount of ink of 7 pl is ejected from the nozzle by the modified waveform. The reason for this phenomenon is that the subsequent modified waveform is applied in the high frequency area before the meniscus after the ink ejection becomes stable.

In summary, in the basic waveform, the appropriate amount of ink (10 pl) is ejected even when the adjustment period (the generation period of the driving waveform) is short. In the modified waveform, however, the amount of ink (9 pl) larger than the target amount of ink (7 pl) is ejected when the adjustment period is short. In other words, in the basic waveform, the appropriate amount of ink (10 pl) is ejected even at a high frequency area. In the modified waveform, however, the appropriate amount of ink (7 pl) may not be ejected at the high frequency area. That is, when the driving signal in which two modified waveforms are generated at a uniform interval in the repetition period is used, the print time becomes longer. Therefore, when the print time is shortened, a problem may arise in that the exact amount of ink is not ejected.

In this way, from the measurement result of FIG. 7, it is apparent that it is difficult to suppress the residual vibration of the meniscus after the ink ejection since the slope θ2 of the modified waveform configured to eject the amount of ink different from the amount of ink ejected by the basic waveform is sharp upon the increase in the potential to the highest potential Vh or the shape of the modified waveform is more complex than that of the basic waveform.

Figure 8:
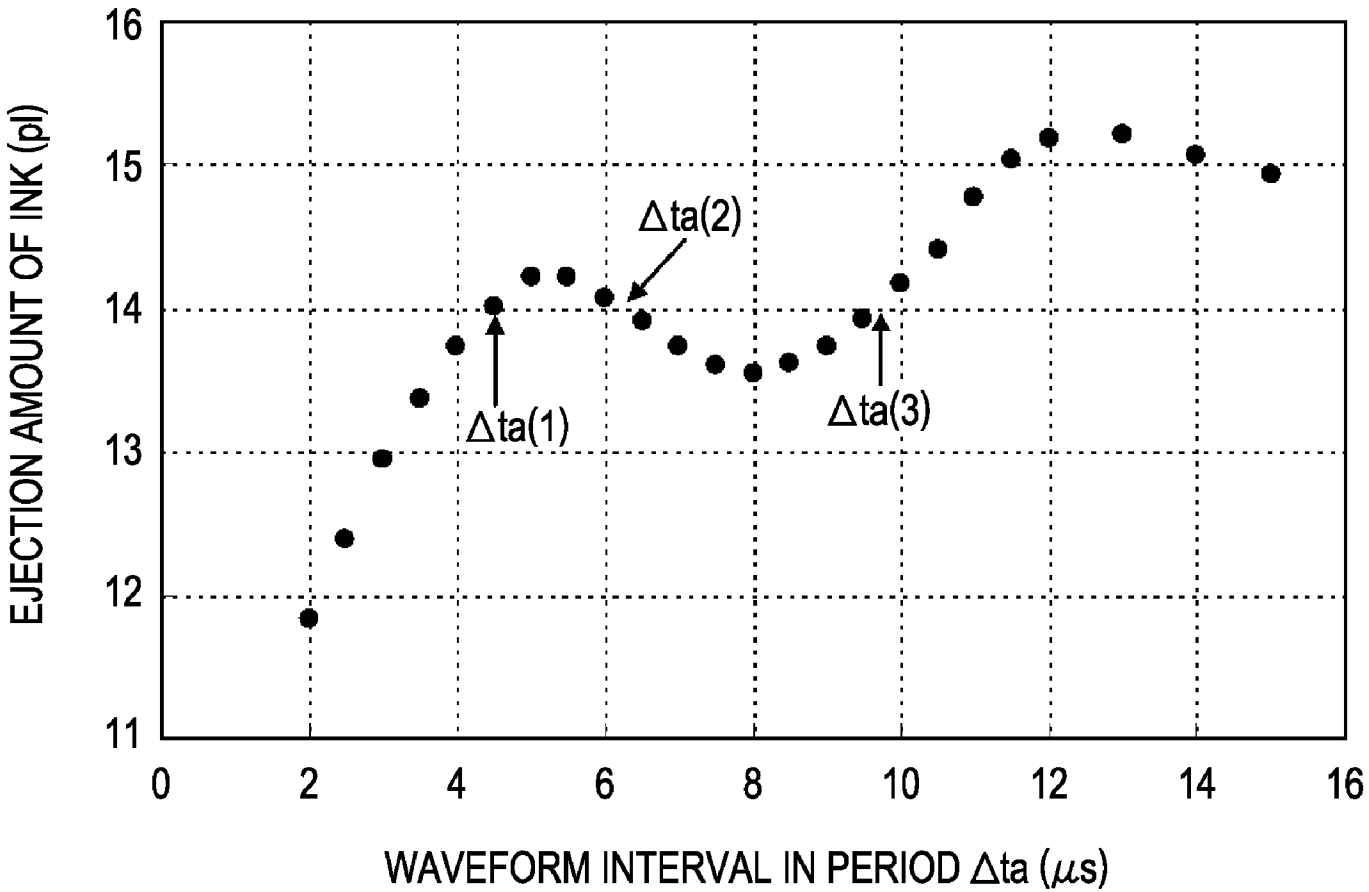
FIG. 8 is a diagram illustrating a measurement result of an ejection amount of ink when a generation interval of the modified waveforms is varied a plural number of times.
Figure 9A:
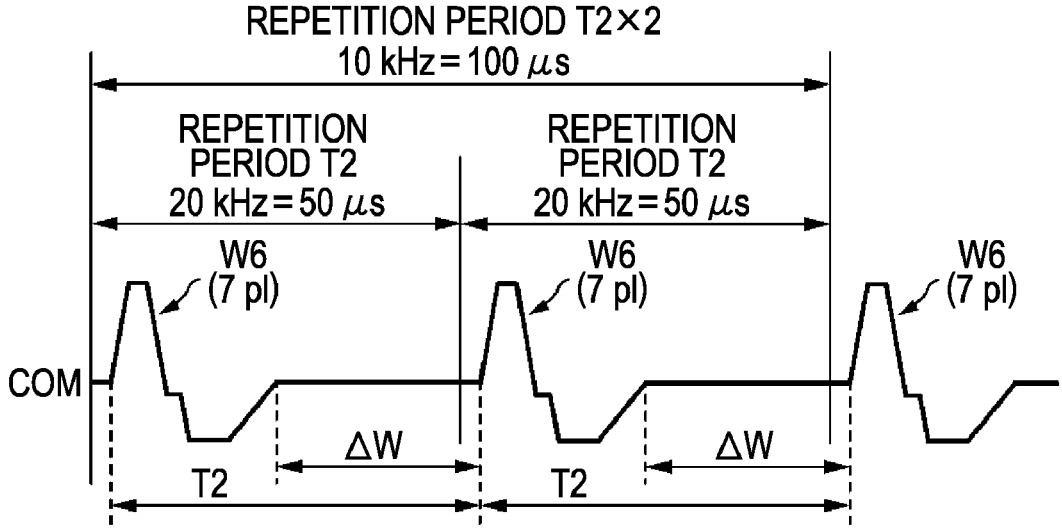
FIG. 9A is a diagram illustrating the driving signal used to acquire the measurement result of FIG. 7.
Figure 9B:
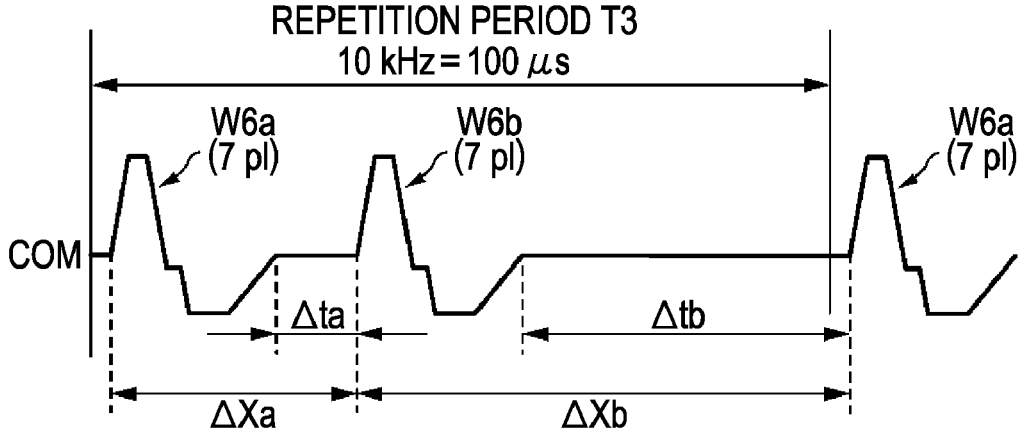
FIG. 9B is a diagram illustrating the driving signal used to acquire the measurement result of FIG. 8.

FIG. 8 is a diagram illustrating the measurement result of the ejection amount of ink when two modified waveforms (see FIG. 6B) are generated in a certain repetition period T and the generation interval Δta of the two modified waveforms is changed a plural number of times. In FIG. 8, the horizontal axis represents the waveform interval Δta (μs) in the period and the vertical axis represents an amount of ink (pl). FIG. 9A is a diagram illustrating the driving signal COM used to acquire the measurement result of FIG. 7. FIG. 9B is a diagram illustrating the driving signal COM used to acquire the measurement result of FIG. 8.

In the driving signal COM used to acquire the measurement result of FIG. 7, as described above, one modified waveform W6 is generated in a repetition period T2, as shown in FIG. 9A. Therefore, a generation interval (=the repetition period T2) and the waveform interval ΔW of the successively generated modified waveforms W6 are constant.

When one small amount waveform W6 is generated successively at 20 kHz for the driving signal COM (see FIG. 9A) (when two modified waveforms W6 are generated for a period of 100 μs), the measurement result of FIG. 7 shows that the ink of "18 pl (=9 pl×2)" is ejected from the nozzle by the two modified waveforms W6. In this way, when the two modified waveforms W6 are generated at a uniform generation period, the ink of 18 pl more than 14 pl, which is a target amount of ink, is ejected at a high frequency area.

On the other hand, in the driving signal used to acquire the measurement result of FIG. 8, two modified waveforms W6 are generated in the repetition period T1, as shown in FIG. 9B. In order to distinguish the two modified waveforms W6 in the repetition period T1 from each other, the first generated modified waveform W6 is referred to as "a previous modified waveform W6*a*" and the subsequently generated small amount waveform W6 is referred to as "a subsequent small amount waveform W6*b*". In the driving signal COM shown in FIG. 9B, the interval of the successively generated modified waveforms W6 is not constant, but the interval Δta of the two modified waveforms W6 in the repetition period T1 is relatively short. Specifically, a generation interval ΔXa (the waveform interval Δta) between the previous modified waveform W6*a* and the subsequent modified waveform W6*b* is shorter than a generation interval ΔXb (waveform interval Δtb) between the subsequent modified waveform W6*b* and the previous modified waveform W6*a* in the next repetition period.

The measurement result of FIG. 8 is a measurement result obtained by measuring the amount of ink ejected from the nozzle by fixing the repetition period T1 of the driving signal COM shown in FIG. 9B to 100 μs and varying the waveform interval Δta (hereinafter, also referred to as the waveform interval Δta in a period) between the modified waveforms W6 in the repetition period T1 a plural number of times. That is, the measurement result is obtained by generating the two modified waveforms W6 at 10 kHz. The measurement result of FIG. 8 is the measurement result obtained by measuring the amount of ink ejected by the two modified waveforms W6 in the repetition period T1 subsequent to the second period for the driving signal COM configured to the two modified waveforms W6 repeatedly in each repetition period T1.

From the measurement result of FIG. 8, the ejection amount of ink is varied and the ejection amount of ink also increases, as the waveform interval Δta in the period is longer. Specifically, in FIG. 8, when the waveform interval Δta in the period is 2 μs at minimum, the amount of ink ejected by the two modified waveforms W6 is 12 pl. When the waveform interval Δta in the period is 15 μs at maximum, the amount of ink ejected by the two modified waveforms W6 is 15 pl. Therefore, in the measurement result of FIG. 8, there is a point where the desired amount of ink ejected by the two modified waveforms W6 is "14 pl". Specifically, when the waveform interval Δta of the two modified waveforms is Δta(1), Δta(2), and Δta(3) in FIG. 8, the target amount of ink of 14 pl is ejected from the nozzle.

In summary, in the driving signal COM configured to generate two modified waveforms W6 in the period of 100 μs at the uniform waveform interval ΔW (when one modified waveform W6 is generated at 20 kHz), as shown in FIG. 9A, the amount of ink (9 pl) larger than the target amount of ink (7 pl) may be ejected, as shown in the measurement result of FIG. 7. When the waveform interval Δta in the period is made different from the waveform interval Δtb outside the period even in the case where the two modified waveforms W6 are generated in the same repetition period T of 100 μs, as shown in FIG. 9B, the target amount of ink (14 pl) can be ejected. In the measurement result of FIG. 8, the target amount of ink can be ejected by relatively shortening the waveform interval Δta between the two modified waveforms W6 in the repetition period T1 (for example, Δta(3)=9.5 μs in FIG. 8) and relatively lengthening the waveform interval Δtb of the modified waveforms W6 outside the repetition period T1.

That is, the target amount of ink can be ejected, even when both the basic waveform (for example, see FIG. 6A), in which the meniscus after the ink ejection becomes stable easily, and the modified waveform (for example, see FIG. 6B), in which the amount of ink different from that of the basic waveform, are provided in the relatively short repetition period T. Therefore, the waveform interval Δta of the modified waveform in the repetition period T may be adjusted on the basis of "the relationship between the waveform interval Δta of the modified waveform and the ejection amount of ink" shown in FIG. 8.

Driving Signal COM According to Embodiment

Figure 10:
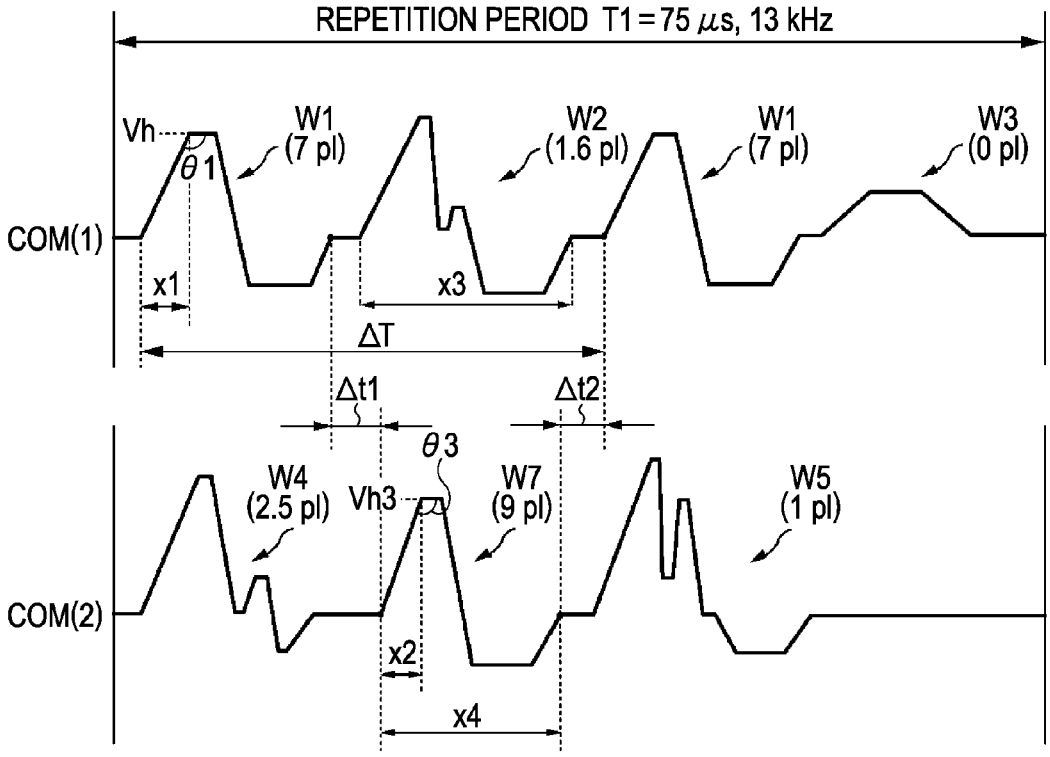
FIG. 10 is a diagram illustrating driving waveforms of the driving signal according to the embodiment.
Figure 11:
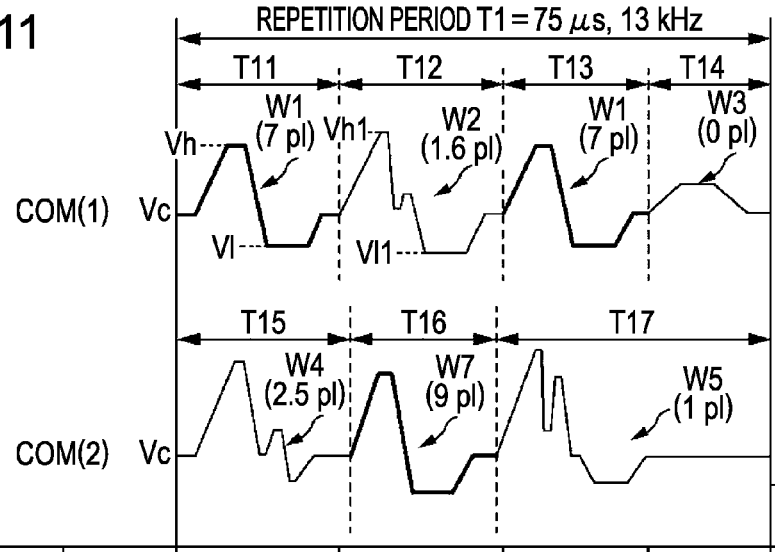
FIG. 11 is a diagram illustrating a relationship between the driving signal according to this embodiment and selection data.

FIG. 10 is a diagram illustrating driving waveforms of the driving signal COM according to this embodiment. FIG. 11 is a diagram illustrating a relationship between the driving signal COM and the selection data q according to this embodiment. In the driving signal COM according to this embodiment, two driving signals COM(1) and COM(2) can be applied to one driving element, as in the driving signal COM according to the comparative example.

In the driving signal according to the above-described comparative example (see FIG. 5), the number of times by which the basic waveform W1 is applied to the piezoelectric element is made different in order to form the dot with the size larger than that of the large dot (7 pl) formed by the basic waveform W1. The very large dot (14 pl) is formed by two basic waveforms W1 and the maximum dot (21 pl) is formed by three basic waveforms W1. For this reason, the ink variation between the dots equal to or larger than the large dot is larger than 7 pl. Moreover, the granularity of an image is not good.

Here, in the second driving signal COM(2) according to this embodiment, a seventh waveform W7 configured to eject the ink of 9 pl is generated, instead of the basic waveform (the first waveform W1) generated for a period T16 of the second driving signal COM(2) according to the comparative example. That is, a modified waveform (the seventh waveform W7) is generated to eject the amount of ink of "9 pl", which is larger than 7 pl ejected by one basic waveform W1 and smaller than 14 pl ejected by two basic waveforms W1. In this embodiment, as shown in FIG. 11, a dot of 9 pl formed by the seventh waveform W7 is referred to as "a large dot". A dot of 14 pl formed by two basic waveforms (the first waveforms W1) is referred to as "a very large dot". In this way, in the driving signal COM according to this embodiment, a different of "5 pl" between the amount of ink used to form the large dot (9 pl) and the amount of ink used to form the very large dot (14 pl) is smaller than a difference of "7 pl" between the amount of ink used to form the large dot (7 pl) and the amount of ink used to form the very large dot (14 pl) in the driving signal COM according to the comparative example. Therefore, the granularity of an image can be improved.

As shown in FIG. 10, the highest potential Vh3 of the seventh waveform W7 configured to eject 9 pl larger than the amount of ink (7 pl) ejected by the basic waveform W1 is higher than that of the basic waveform W1 (where Vh3>Vh1). In the seventh waveform W7, the angle upon the increase in the potential to the highest potential Vh3 is sharper than that of the basic waveform W1 (where θ3<θ1) and a voltage increase time from the middle potential Vc to the highest potential Vh3 is shorter than that of the basic waveform W1 (where X2<X1). As in the sixth waveform W6 described with reference to FIG. 6B, in the seventh waveform W7, the angle of upon the increase in the potential is sharper than that of the basic waveform W1, and the meniscus after the ink ejection rarely becomes stable. However, when one seventh waveform W7 is generated in the repetition period T1 (=75 μs) (when the seventh waveform W7 is generated at 13 kHz), as in forming the large dot (9 pl), the appropriate amount of ink (9 pl) can be ejected. This is because a time necessary for suppressing the residual vibration after the ink ejection by the seventh waveform W7 can be ensured to be relatively long.

The shape of the sixth waveform W6 shown in FIG. 6B is different from that of the seventh waveform W7 in the driving signal COM according to this embodiment. The sixth waveform W6 is a driving waveform configured to eject the amount of ink smaller than the amount of ink ejected by the basic waveform W1. However, as for the sixth waveform W6, it is considered that the meniscus after the ink ejection rarely becomes stable likewise. As for the relationship between "the frequency and the ejection amount of ink of the modified waveform (the sixth waveform W6)" shown in FIG. 7, the target amount of ink (7 pl) is ejected at 13 kHz. Therefore, when the seventh waveform W7 of the driving signal COM according to this embodiment is generated at 13 kHz, it can be considered that the ink of 9 pl, which is the target amount of ink, is ejected.

Since the large dot is formed not by the basic waveform W1 configured to eject the ink of 7 pl but by the seven waveform W7 configured to eject the ink of 9 pl, the ink variation (5 pl) between the large dot (9 pl) and the very large dot (14 pl) can be made small. At this time, the very large dot is formed by two basic waveforms W1 and one seventh waveform W7. Here, when the same amount of ink as that ejected upon applying the driving waveform W1 and W7 to the piezoelectric element singularly in a case where the very large dot is formed by the three driving waveforms W1 and W7, the amount of ink (7×2+9=23 pl) used to form the very large dot according to this embodiment may be larger than the amount of ink (7×3=21 pl) used to form the very large dot according to the comparative example. Then, even though the amount of ink ejected by the seventh waveform W7 configured to eject the ink larger than the ink ejected by the basic waveform W1 approaches the ink variation (5 pl) between the large dot (9 pl) and the very large dot (14 pl), the ink variation amount (9 pl) between the very large dot (14 pl) and the maximum dot (23 pl) may be larger.

In this embodiment, however, when the very large dot is formed by the two basic waveforms W1 and the seventh waveform W7, the waveform interval between the driving waveforms W1 and W7 is adjusted so as to eject the amount of ink (for example, 20 pl) smaller than the sum (7×2+9=23 pl) of the amount of ink ejected from the nozzle upon applying the driving waveform W1 and W7 to the piezoelectric element singularly.

When the modified waveform (the sixth waveform W6 in FIG. 6B) in which the meniscus after the ink ejection rarely becomes stable is generated in the high frequency area (for example, 20 kHz), as described above, it can be known that the amount of ink larger than the target amount of ink (7 pl) is ejected, as shown in FIG. 7. It can be known that the ejection amount of ink is varied from the amount of ink smaller than the target amount of ink (14 pl) to the amount of ink larger than the target amount of ink by adjusting the waveform interval of the modified waveform W6, as shown in FIG. 8. That is, when the modified waveform in which the meniscus after the ink ejection rarely becomes stable is used in the high frequency area, the target amount of ink can be ejected by adjusting the waveform interval Δta of the modified waveform W6 as well as ejecting the amount of ink larger than the target amount of ink, as shown in FIG. 7.

In the driving signal COM according to this embodiment, as shown in FIG. 10, a waveform interval Δt2 between the modified waveform (the seventh waveform W7), in which the meniscus after the ink ejection rarely becomes stable, and the basic waveform W1 generated after the repetition period T1 is adjusted. That is, when the very large dot is formed, the basic waveform W1 after the repetition period T is applied while the meniscus after the ink ejection by the modified waveform W7 does not become stable. Therefore, the waveform interval Δt2 is adjusted so that the amount of ink ejected by the basic waveform W1 after the repetition period T is smaller than 7 pl ejected upon applying the waveform to the piezoelectric element singularly (in this case, when both the first driving waveform and the second driving waveform are applied to the driving element, the amount of liquid smaller than the first amount of liquid is ejected by the first driving waveform generated after the predetermined period).

Even in the basic waveform W1 in which the meniscus after the ink ejection becomes stable easily, the meniscus after the ink ejection rarely becomes stable, when three driving waveforms are applied to the piezoelectric element for the repetition period T1 (75 μs), like the case where the very large dot is formed. That is, the modified waveform W7 is applied to the piezoelectric element, while the meniscus after the ink ejection by the basic waveform W1 before the repetition period T1 is not stable. At this time, the waveform interval Δt1 between the basic waveform W1 generated earlier in the repetition period T1 and the modified waveform W7 is adjusted so that the amount of ink ejected by the modified waveform W7 is smaller than 9 pl ejected upon the waveform to the piezoelectric element singularly when the maximum dot is formed (in this case, when both the first driving waveform and the second driving waveform are applied to the driving element, the amount of liquid smaller than the second amount of liquid is ejected by the second driving waveform generated after the predetermined period).

In this way, in the driving signal COM according to this embodiment, the amount of ink ejected by the modified waveform W7 or the basic waveform W1 after the repetition period T is reduced to an amount of ink smaller than the amount of ink (9 pl or 7 pl) ejected by the single driving waveform W7 or W1 by adjusting the waveform intervals Δt1 and Δt2 of the three driving waveforms W1 and W7 configured to form the very large dot. By doing so, it is possible to eject the amount of ink (20 pl) smaller than the sum (7×2+9=23 pl) of the amount of ink ejected from the nozzle upon applying the single driving waveform W1 or W7 to the piezoelectric element, when the very large dot is formed. As a consequence, since the ejection amount of ink approaches the ink variation amount (5 pl) between the large dot (9 pl) and the very large dot (14 pl) and also approaches the ink variation amount (6 pl) between the very large dot (14 pl) and the maximum dot (20 pl), the granularity of an image can be improved.

In the above-described driving signal COM (see FIG. 5) according to the comparative example, the amount of ink ejected by the three basic waveforms W1 is "21 pl". However, even in the basic waveform W1 in which the meniscus after the ink ejection becomes stable easily, when the three basic waveforms W1 are generated in the repetition period T1, the subsequent basic waveform W1 is applied in some cases, while the meniscus after the ink ejection is not stable. That is, in the driving signal COM according to the comparative example, when the waveform intervals between the three basic waveforms in the repetition period T1 are not adjusted, the amount of ink smaller than 21 pl or the amount of ink larger than 21 pl may be ejected upon forming the very large dot. Then, a gap may occur in solid printing, since the very large is too small. On the contrary, the ink variation amount between the large dot (14 pl) and the very large dot may be large, since the very large is too large. Therefore, the granularity of an image may deteriorate.

In the driving signal COM according to this embodiment, however, the waveform intervals Δt1 and Δt2 of the plural driving waveforms W1 and W7 are adjusted to eject the target amount of ink (20 pl), when the plural driving waveforms W1 and W7 are applied to the piezoelectric element for the repetition period T1. Accordingly, the granularity of an image can be improved reliably.

Moreover, the two basic waveforms W1 are applied to the piezoelectric elements for the repetition period T1 and the very large dot (14 pl) is thus formed. It is preferable that a generation interval ΔT of two basic waveforms W1 is set to the same value as or a value close to the half period of the repetition period T1 (where ΔT=T/1;2). The reason is described as follows.

As described above, the residual vibration of the meniscus after the ink ejection by the basic waveform W1 is suppressed more easily than the residual vibration of the ink ejection by the other driving waveforms. That is, a time necessary when the meniscus after the ink ejection by the basic waveform W1 becomes stable is shorter than that of the other driving waveforms. Therefore, in order to form the very large dot (14 pl), the subsequent basic waveform W1 is applied to the piezoelectric element after the residual vibration of the meniscus after the ink ejection by the basic waveform W1 becomes stable. Accordingly, the amount of ink of "14 pl", which is a double of the amount of ink (7 pl) ejected by the signal basic waveform W1, is ejected by the two basic waveforms W1.

For this reason, in order to form the large dot, it is necessary to stabilize the meniscus after the ink ejection by the basic waveform W1. Therefore, it is necessary to set both the generation interval ΔT of the basic waveform W1 in the repetition period T1 and the generation interval (not shown) of the basic waveform W1 outside the repetition period T1 to be as long as possible. Here, in the driving signal COM according to this embodiment, the generation intervals ΔT of the basic waveforms W1 in and outside the repetition period T1 are set to the half period (T1/2) of the repetition period T1 or a value close to the half period. By doing so, the amount of ink (14 pl) ejected by the two basic waveforms W1 can be set to the double of the amount of ink (7 pl) ejected upon applying the basic waveform W1 to the piezoelectric element singularly.

When the generation interval ΔT of the basic waveform W1 is set to the half period (T/1;2) of the repetition period T1 or a value close to the half period, the basic waveform W1 is generated in each of the first half and the second half of the repetition period T1. In this way, by arranging the two basic waveforms W1 in the repetition period T1 in a good balanced manner, two dots formed by the basic waveforms W1 are arranged uniformly in a pixel. Since the dots formed by the basic waveforms W1 are relatively large, the image quality can be improved by arranging the dots uniformly in the pixel.

Hereinafter, the driving signal COM according to this embodiment will be described in detail. In the driving signal COM according to this embodiment, six kinds of dots are used for one pixel and seven gray scales are expressed for one pixel. The six kinds of dots include the tiny dot (1 pl), the small dot (1.6 pl), the middle dot (2.5 pl), the large dot (9 pl), the very large dot (14 pl), and the maximum dot (20 pl).

In the first driving signal COM(1), the basic waveform W1 is generated to eject the ink of 7 pl for a time T11 of the repetition period T1, the second waveform W2 is generated to eject the ink of 1.6 pl for a time T12, the basic waveform W1 is generated to eject the ink of 7 pl for a time T13, and the third waveform W3 for minute vibration is generated for a time T14.

On the other hand, in the second driving signal COM(2), the fourth waveform W4 is generated to eject the ink of 2.5 pl for a time T15 of the repetition period T1, the seventh waveform W7 is generated to eject the ink of 9 pl for a time T16, and the fifth waveform W5 is generated to eject the ink of 1 pl for a time T17.

Since the repetition period T1 of the first driving signal COM(1) is divided into four periods, the corresponding selection signals q0 to q6 can be expressed by 4-bit data. In addition, since the repetition period T1 of the second driving signal COM(2) is divided into three periods, the corresponding selection signals q7 to q13 can be expressed by 3-bit data.

When the dot formation data SI indicate "no dot", the selection data q0 for the first driving signal COM(1) is represented by "0001" and the selection data q7 for the second driving signal COM(2) is represented by "000". Then, the third waveform W3 is applied. Likewise, when the dot formation data SI indicates "tiny dot formation (1 pl)", the selection data q1 is represented by "0000" and the selection data q8 is represented by "001". Then, the fifth waveform W5 is applied. When the dot formation data SI indicates "small dot formation (1.6 pl)", the selection data q2 is represented by "0100" and the selection data q9 is represented by "000". Then, the second waveform W2 is applied. When the dot formation data SI indicates "middle dot formation (2.5 pl), the selection data q3 is represented by "0000" and the selection data q10 is represented by "100". Then, the fourth waveform W4 is applied.

When the dot formation data SI indicates "large dot formation (9 pl), the selection data q4 is represented by "0000" and the selection data q11 is represented by "010". Then, the seventh waveform W7 is applied. When the dot formation data SI indicates "very large dot formation (14 pl), the selection data q5 is represented by "1010" and the selection data q12 is represented by "000". Then, the two basic waveforms W1 are applied. When the dot formation data SI indicates "maximum dot formation (20 pl), the selection data q6 is represented by "1010" and the selection data q13 is represented by "010". Then, the two basic waveforms W1 and the seventh waveform W7 are applied.

In summary, in the driving signal COM according to this embodiment, the two basic waveforms W1 (corresponding to a first driving waveform) and the seventh waveform W7 (corresponding to a second driving waveform) are generated in the repetition period T1 (corresponding to a predetermined period). In addition, the two basic waveforms W1 and the seventh waveform W7 are generated repeatedly for each repetition period T1. The waveform intervals (Δt1 and Δt2 in FIG. 10) of the driving waveforms W1 and W7 applied to the piezoelectric element in the same repetition period T1 are adjusted. Then, when the basic waveform W1 is applied to the piezoelectric element, the ink of 7 pl (corresponding to a first amount of liquid) is ejected from the nozzle. When the two basic waveforms W1 are applied to the piezoelectric element, the ink of 14 pl, which is the double of 7 pl, is ejected from the nozzle. When the seventh waveform W7 is applied to the piezoelectric element, the ink of 9 pl (corresponding to a second amount of liquid) larger than the ink of 7 pl and smaller than the ink of 14 pl, which is the double of 7 pl, is ejected from the nozzle. When the two basic waveforms W1 and the seventh waveform W7 are applied to the piezoelectric element, the amount of ink of "20 pl" smaller than the sum "23 pl" of the ink of 14 pl, which is the double of 7 pl, and the ink of 9 pl is ejected from the nozzle. According to the driving signal COM, the ink variation amounts among the large dot (9 pl), the very large dot (14 pl), and the maximum dot (20 pl) can be smaller than that of the driving signal COM (see FIG. 5) according to the comparative example. Therefore, the granularity of an image can be improved.

In a printer using the driving signal COM of which the variation in the dot size is larger, as in the driving signal COM (see FIG. 5) according to the comparative example, than the driving signal COM according to this embodiment, light ink such as light cyan or light magenta may be used in addition to ink of four colors (for example, yellow, magenta, cyan, and black) to improve the granularity of the print image. However, in a printer 1 using the driving signal COM according to this embodiment, the variation in the dot size can be made small. Therefore, the granularity can be improved without using the color ink other than the ink of four colors.

Instead of the seventh waveform W7 configured to eject the ink of 9 pl, a driving waveform configured to eject ink of 8 pl may be generated. In this way, the ink variation amount between the large dot (8 pl) and the very large dot (14 pl) can be made small, compared to the driving signal COM according to the comparative example. Accordingly, the granularity of an image can be improved. When the amount of ink used to form the large dot increases from 7 pl to 9 pl, the ink variation amount (6.5 pl) between the middle dot (2.5 pl) and the large dot (9 pl) is increased. Therefore, the amount of ink used to form the middle dot may be increased to 5 pl, for example.

In the driving signal COM shown in FIG. 11, the six kinds of dots (1 pl, 1.6 pl, 2.5 pl, 9 pl, 14 pl, and 20 pl) are used to express the seventh gray scales for one pixel, but the invention is not limited thereto. In the driving signal COM shown in FIG. 11, one basic waveform W1 of the time T11 or T13 may be selected by the selection data. In this way, since "a dot of 7 pl" is additionally formed by the one basic waveform W1, seven kinds of dots (1 pl, 1.6 pl, 2.5 pl, 7 pl, 9 pl, 14 pl, and 20 pl) can be formed. Accordingly, since eight gray scales can be expressed for one pixel, the granularity of an image can be improved.

According to this embodiment, the two basic waveforms W1 are generated in the first driving signal COM(1) and the seventh waveform W7 is generated in the second driving signal COM(2). In the driving signal COM according to this embodiment, the driving waveforms W1 and W7 which are likely to be applied to the piezoelectric element in the same repetition period T1 are separately formed in the first driving signal COM(1) and the second driving signal COM(2). In this way, the amount of heat generated in the driving signal generating circuit 15 upon applying the driving waveforms W to the piezoelectric element can be dispersed to the driving signal generating circuit 15 generating the first driving signal COM(1) and the driving signal generating circuit 15 generating the second driving signal COM(2). For example, when solid printing is performed, the maximum dot (the dot of 20 pl) is used numerously. For this reason, when the two basic waveforms W1 the seventh waveform W7 are generated in one driving signal COM, the amount of heat generated by the driving signal generating circuit 15 generating the one driving signal COM become larger, thereby causing the breakdown.

In the seventh waveform W7, as shown in FIG. 10, a time during which the voltage increases from the middle voltage Vc to the highest voltage Vh3 is relatively short. For this reason, a 4 multiple of a potential variation time of the seventh waveform W7 is shorter than a 3 multiple of a potential variation time of the second waveforms W2 generated between the two basic waveforms W1. On the other hand, in order to make the generation interval ΔT between the two basic waveforms W1 as long as possible, it is preferable to approach the half period of the repetition period T1. Accordingly, even when the short seventh waveform W7 with a 4 multiple of the potential variation time is generated between the two basic waveforms W1, the generation interval ΔT of the two basic waveforms W1 may not be filled. For this reason, the maintenance period of the middle potential Vc may becomes longer unnecessarily. In this case, by generating the two basic waveforms W1 and the seventh waveform W7 in different driving signals COM, the second waveform W2 with a 3 multiple of the potential variation time can be generated between the two basic waveforms W1. Therefore, the driving waveforms W may be generated effectively. In other words, by generating the driving waveform other than the modified waveform W7 between the two basic waveforms W1, a freedom of design of the driving waveforms may be improved.

Driving Signal COM According to Modified Example

Figure 12A:
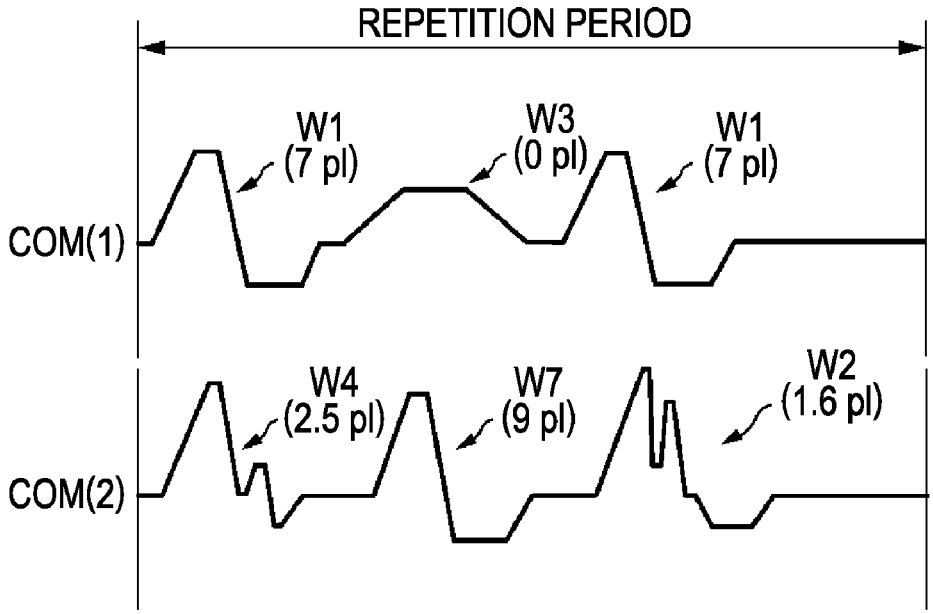
FIGS. 12A and 12B are diagrams illustrating driving signals according to modified examples.

FIG. 12A is a diagram illustrating the driving signal COM in which the number of kinds of dots is reduced. In the above-described driving signal COM shown in FIG. 11, the six kinds of dots are used for one pixel and the seven gray scales are thus expressed for one pixel, but the invention is not limited thereto. The number of kinds of dots may be reduced. For example, in the driving signal COM shown in FIG. 12A, five kinds of dots (a dot of 20 pl, a dot of 14 pl, a dot of 9 pl, a dot of 2.5 pl, and a dot of 1.6 pl) may be formed and six gray scales may thus be expressed for one pixel.

In the driving signal COM, the dot of 9 pl is formed by the seventh waveform W7 and the waveform intervals of two basic waveforms W1 and the seventh waveform W7 are adjusted to form the dot of 20 pl. Therefore, the granularity of an image can be improved, since the ink variation amount can be reduced, compared to the driving signal COM (see FIG. 5) according to the comparative example. When the length of the repetition period T is different, the waveform intervals Δt1 and Δt2 at which the desired amount of ink is ejected are also different. Since the repetition period T is shorter in the driving signal COM of FIG. 12A than in the driving signal COM of FIG. 10, the waveform intervals Δt1 and Δt2 are also different.

As a modified example of the driving signal COM, a driving signal COM (not shown) may be used in which only two basic waveforms W1, one modified waveform W7, the waveform W3 for minute vibration are generated. In this case, three or four kinds of dots (a dot of 7 pl, a dot of 9 pl, a dot of 14 pl, and a dot of 20 pl) may be formed. Even when the relatively large dots are formed in a small range without forming the dot with a tiny size, the granularity of a print image can be improved, by making the increase amount of the ink small from the smaller dot to the larger dot.

Figure 12B:
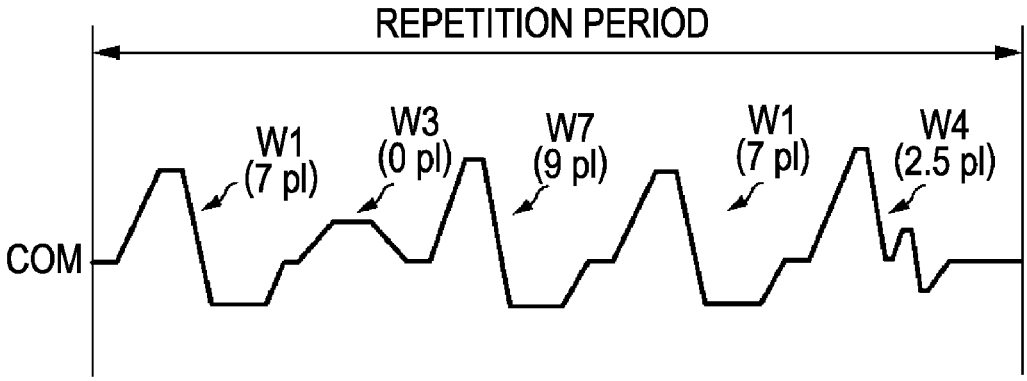

FIG. 12B is a diagram illustrating one driving signal COM which can be applied to the piezoelectric element. When the number of kinds of dots is reduced and the number of driving waveforms is reduced in comparison to the above-described driving signal COM (see FIG. 11), only one driving signal COM which can be applied to the piezoelectric element may be used. In this way, when one driving signal generating circuit 15 is provided to one nozzle row, the circuit can be simplified.

In the driving signal COM, the dot of 9 pl is formed by the seventh waveform W7 and the dot of 20 pl is formed by adjusting the waveform intervals of the two basic waveforms W1 and the seventh waveform W7. Therefore, the granularity of an image can be improved, since the ink variation amount can be made small in comparison to the driving signal COM (see FIG. 5) according to the comparative example.

Process of Designing Driving Signal COM

Figure 13:
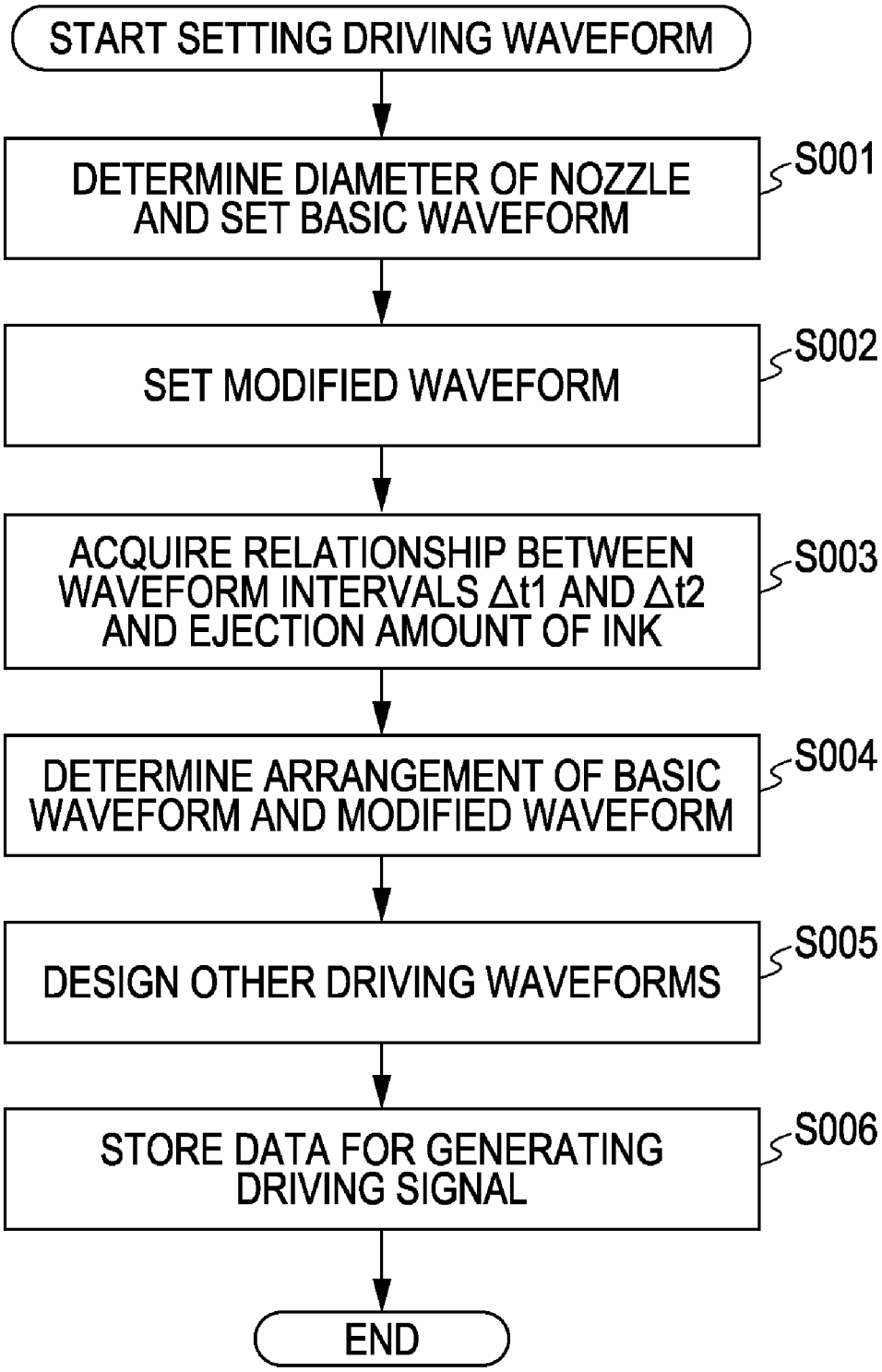
FIG. 13 is a diagram illustrating a method of designing the driving waveform in the driving signal.

FIG. 13 is a diagram illustrating a method of designing the driving waveforms W of the driving signal COM. Hereinafter, the method of designing the driving signals COM described with reference to FIG. 11 or FIGS. 12A and 12B will be described. In a process of designing the printer 1, the driving signal COM used by the printer 1 is designed. In this case, the amount of ink (here, 7 pl) ejected by the basic waveform W1 in which the meniscus after the ink ejection is stable is first determined. That is, the size of the very large dot (here, 14 pl) formed by the two basic waveforms W1 is determined. Subsequently, the diameter of the nozzle and the basic waveform (parameters such as Vh) are determined so that the determined amount of ink (7 pl) is ejected from the nozzle by the driving waveform in which the meniscus after the ink droplet ejection become stable easily even the high frequency area (S001).

Subsequently, in order to improve the granularity, the modified waveform (the seventh waveform W7) is designed to eject the amount of ink (here, the ink of 9 pl) between the ink of 7 pl ejected by one basic waveform W1 and the ink of 14 pl ejected by two basic waveforms W1 (S002). That is, the modified waveform W7 is designed so as to eject the ink of 9 pl from the nozzle with the diameter ejecting the ink of 7 pl by the basic waveform in which the meniscus after the ink ejection becomes stable easily.

When the ink variation amount of the dot (14 pl) formed by two basic waveforms W1 and the dot (9 pl) formed by one modified waveform W7 is made small and thus the amount of ink of the very large dot formed by the three driving waveforms W1 and W7 increases, the granularity of an image may not be improved. In this embodiment, however, by adjusting the waveforms (Δt1 and Δt2 in FIG. 10) of the three driving waveforms W1 and W7 configured to the very large dot, the amount of ink ejected by the modified waveform W7 or the basic waveform W1 generated after the repetition period T can be reduced further than the amounts of ink (9 pl and 7 pl) ejected from the nozzles by the single driving waveform W7 and the signal driving waveform W1. Therefore, "the relationship between the waveform intervals and the ejection amount of ink" shown in FIG. 8 is acquired (S003).

Figure 14A:
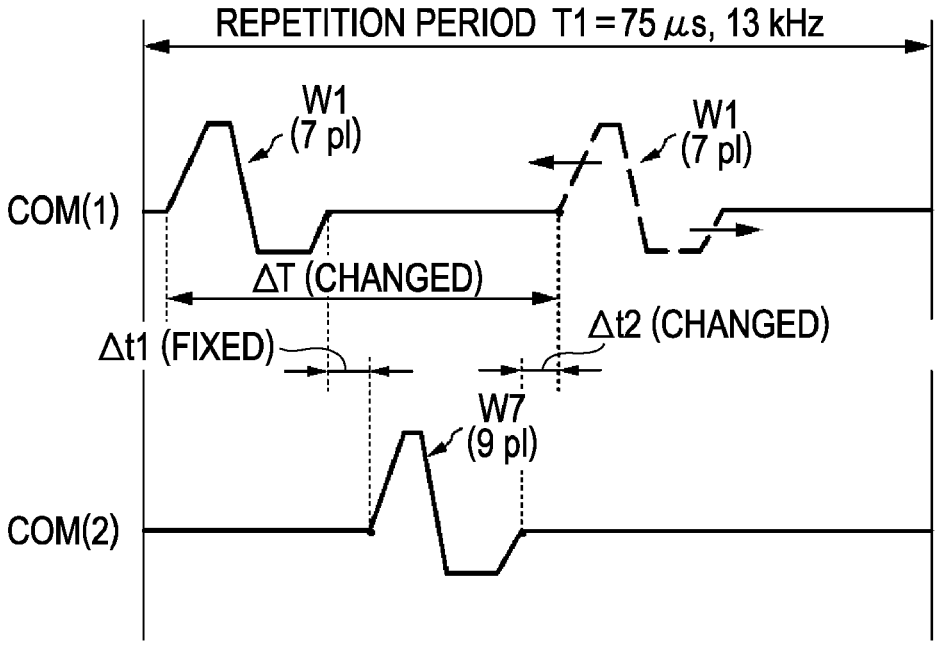
FIGS. 14A and 14B are diagrams illustrating adjustment of waveform intervals.

FIG. 14A is a diagram illustrating the waveform intervals adjusted by delaying the position of the basic waveforms W1 generated after the repetition period T1. That is, by adjusting the waveform interval Δt2 between the modified waveform W7 and the subsequent basic waveform W1 (adjusting a temporal interval at which the second driving waveform is generated and then the first driving waveform generated subsequently in a predetermined period is generated), the amount of ink (20 pl) used to form the very large dot is adjusted. As described above, it is preferable that the generation interval ΔT of the two basic waveforms W1 is set to the half period of the repetition period T1 or the value close to the half period. Therefore, the generation interval ΔT is first set in this manner. However, the generation interval ΔT of the two basic waveforms W1 may be deviated by delaying the position of the subsequent basic waveform W1 (indicated by a dot line) in the repetition period T1. At this time, when the very large dot (14 pl) is formed by the two basic waveforms W1, the second basic waveform W1 is applied to the piezoelectric element after the meniscus after the ink ejection by the first basic waveform W1 is stable. For this reason, even when the generation interval ΔT between the two basic waveforms W1 is slightly changed, the ejection amount of ink of 14 pl is maintained. Accordingly, even when the position of the subsequent basic waveform W1 is delayed to adjust the amount of ink of the maximum dot (20 pl), the maximum dot is formed with the target amount of ink (14 pl).

As shown in FIG. 14A, the amount of ink ejected by the two basic waveforms W1 and the modified waveform W7 is measured by varying the waveform intervals Δt2 between the modified waveform W7 and the subsequent basic waveform W1 a plural number of times (that is, the position of the basic waveform W1 after the repetition period T1 is varied a plural number of times). The basic waveform W1 or the modified waveform W7 is designed and the length of the repetition period T may also be determined in accordance with a necessary print processing speed. By varying the waveform interval Δt2 between the modified waveform W7 and the subsequent basic waveform W1 in the determined predetermined repetition period T a plural number of times, the amount of ink ejected by the three driving waveforms W1 and W7 is measured, and "the relationship between the waveform interval Δt2 and the ejection amount of ink" is acquired.

On the basis of the relationship between the waveform interval Δt2 and the ejection amount of ink, the waveform interval Δt2 is acquired at which the desired ejection amount of ink (20 pl) smaller than the sum (23 pl) of the ink ejected by the three driving waveforms W1 and W7 singularly is ejected. In this way, the arrangement (generation position) of the two basic waveforms W1 and the modified waveform W7 in the repetition period T can be determined (S004). The subsequent basic waveform W1 in the repetition period T1 has been delayed. However, when the waveform interval Δt2 at which the desired amount of ink (20 pl) is maintained, the positions of the driving waveforms W1 and W7 shown in FIG. 14B may be delayed right or left.

In this case, the waveform interval Δt1 between the previous basic waveform W1 and the modified waveform W7 is fixed. Therefore, by varying the waveform interval Δt2 a plural number of times and adjusting the ejection amount of ink without varying the amount of ink ejected by the modified waveform W7, the amount of ink ejected by the subsequent basic waveform W1 is adjusted. In this way, the waveform interval Δt2 is acquired at which the desired amount of ink (20 pl) by the three driving waveforms W1 and W7 is ejected.

However, since the waveform interval Δt1 between the previous basic waveform W1 and the modified waveform W7 in the repetition period T1 is fixed, a predetermined amount of ink is ejected by the modified waveform W7. When the three driving waveforms W1 and W7 in the repetition period T1 are generated, the waveform interval Δt1 between the previous basic waveform W1 and the modified waveform W7 becomes relatively short. From the measurement result of FIG. 8, it can be known that the amount of ink smaller than target amount of ink is ejected when the waveform interval Δta is short. For this reason, it is predicted that the amount of ink ejected by the modified waveform W7 upon applying the three driving waveforms W1 and W7 to the piezoelectric element is smaller than the amount of ink (9 pl) ejected by the modified waveform W7 singularly.

Figure 14B:
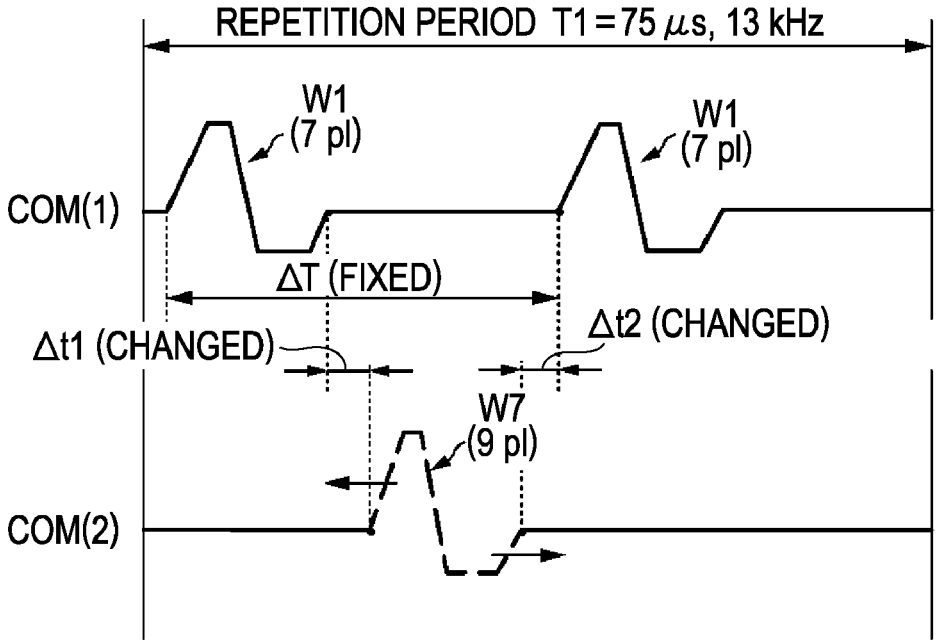

FIG. 14B is a diagram illustrating the waveform interval adjusted by delaying the position of the modified waveform W7. In this case, the amount of ink (20 pl) used to form the maximum dot is adjusted by adjusting the waveform interval Δt1 between the previous basic waveform W1 in the repetition period T1 and the modified waveform W7 and the waveform interval Δt2 between the modified waveform W7 and the subsequent basic waveform W1 in the repetition period T1. In this case, since the generation interval ΔT between the two basic waveforms W1 is not deviated, the generation interval ΔT between the two basic waveforms W1 is maintained to the half period of the repetition period T1 or a value close to the half period. Accordingly, the generation interval ΔT between the two basic waveforms W1 can be set to a more preferable interval in the case of FIG. 14B than in the case of FIG. 14A.

By varying the waveform interval Δt1 between the previous basic waveform W1 and the modified waveform W7 and the waveform interval Δt2 between the modified waveform W7 and the subsequent basic waveform W1 in the predetermined repetition period T plural numbers of times (by varying a temporal interval, at which the first driving waveform previously generated in a predetermined period is generated and then the second driving waveform is generated, and a temporal period, at which the second driving waveform is generated and then the first driving waveform subsequently generated in the predetermined period, plural numbers of times), the amount of ink ejected by the two basic waveforms W1 and the modified waveform W7 is measured, and "the relationship between the waveform intervals Δt1 and Δt2 and the ejection amount of ink" is acquired. The positions of the two basic waveforms W1 in the repetition period T1 are fixed. Therefore, when one of the two waveform intervals Δt1 and Δt2 is varied, the other thereof is thus decided. By doing so, the waveform intervals Δt1 and Δt2 at which the desired amount of ink (20 pl) is ejected by the three driving waveforms W1 and W7 are acquired on the basis of the relationship between the waveform intervals Δt1 and Δt2 and the ejection amount of ink. In this way, the arrangement of the basic waveforms W1 and the modified waveform W7 in the repetition period T is determined (S004).

In this case, both the waveform interval Δt1 between the previous basic waveform W1 and the modified waveform W7 and the waveform interval Δt2 between the modified waveform W7 and the subsequent basic waveform W1 are varied. Therefore, both the amount of ink ejected by the modified waveform W7 and the amount of ink ejected by the basic waveforms W1 are adjusted so that the amount of ink ejected by the three driving waveforms W1 and W7 is the desired amount of ink (20 pl).

As for "the relationship between the waveform intervals Δt1 and Δt2 and the ejection amount of ink", when there are several waveform intervals Δt1 and Δt2 at which the desired amount of ink is ejected, one thereof is determined. For example, in the relationship between the waveform intervals Δta and the ejection amount of ink in FIG. 8, three candidate waveform intervals Δta (Δta(1), Δta(2), and Δta(3)) are present, when the desired amount of ink is set to 14 pl.

As a method of determining the waveform interval Δta among the plural candidate waveform intervals, the waveform interval is determined on the basis of the length of the waveform interval Δta. For example, by selecting the waveform interval Δta with a short length (Δta(1) in the measurement result of FIG. 8), it is possible to improve a freedom of design of another driving waveform (other than the basic waveforms W1 and the modified waveform W7) designed in the repetition period T1.

Otherwise, the waveform interval Δta may be determined on the basis of the ejection feature of the ink droplet at each candidate waveform interval Δta. For example, by confirming whether satellites (tiny ink droplets) after the ink droplet ejection at each candidate waveform interval Δta are generated, the waveform interval Δta at which the satellites are rarely generated may be selected. In this way, the image quality can be prevented from deteriorating due to the satellites.

The waveform interval Δta may be determined on the basis of the variation in the ejection amount of ink at each candidate waveform interval Δta. The variation in the ejection amount of ink corresponds to "a slope" of each candidate waveform interval Δta in the result (the measurement result plotted in the graph of FIG. 8) indicating the variation in the ejection amount of ink. Specifically, by calculating the variation in the ejection amount of ink for a predetermined period (Δta±predetermined time (μs)) before and after the candidate waveform interval Δta, the waveform interval Δta with a small variation is selected. Accordingly, even when the waveform interval Δta may be slightly deviated due to an error upon generating the driving signal COM, the amount of ink close to the desired amount of ink is ejected. When the waveform intervals Δt1 and Δt2 of the small amount waveforms are determined, the invention is not limited to the method of considering one of the length, the other ejection features, and the variation in the ejection amount of ink, but the plurality thereof may be considered.

Subsequently, when the arrangement of the two basic waveforms W1 and the modified waveform W7 in the repetition period T1 is determined, the driving waveform W is designed to form the dot of a size other than that of the dot formed in the basic waveforms W1 and the modified waveform W7 (S005). For example, in the case of the driving signal COM shown in FIG. 11, the driving waveforms (W4, W2, and W5) are designed to eject the amount of ink of "2.5 pl, 1.6 pl, and 1 pl" and the waveform W3 for the minute vibration is designed.

After the driving signal COM used in the printer 1 is designed, data prepared to create the driving signal COM is stored in the memory 13 or the like of the printer 1 (S006). Specifically, since the controller 10 of the printer 1 permits the driving signal generating circuit 15 to generate the driving signal COM in the actual printing, the data (corresponding to the data prepared to create the driving signal such as the DAC value in FIG. 3) output to the driving signal generating circuit 15 is stored in the memory 13. In the printer 1 using the driving signal COM designed in accordance with the flow of FIG. 13, the granularity of an image is improved. The designing sequence of the driving signal COM shown in FIG. 13 is just an example, and the invention is not limited thereto.

Modified Examples

Figure 15:
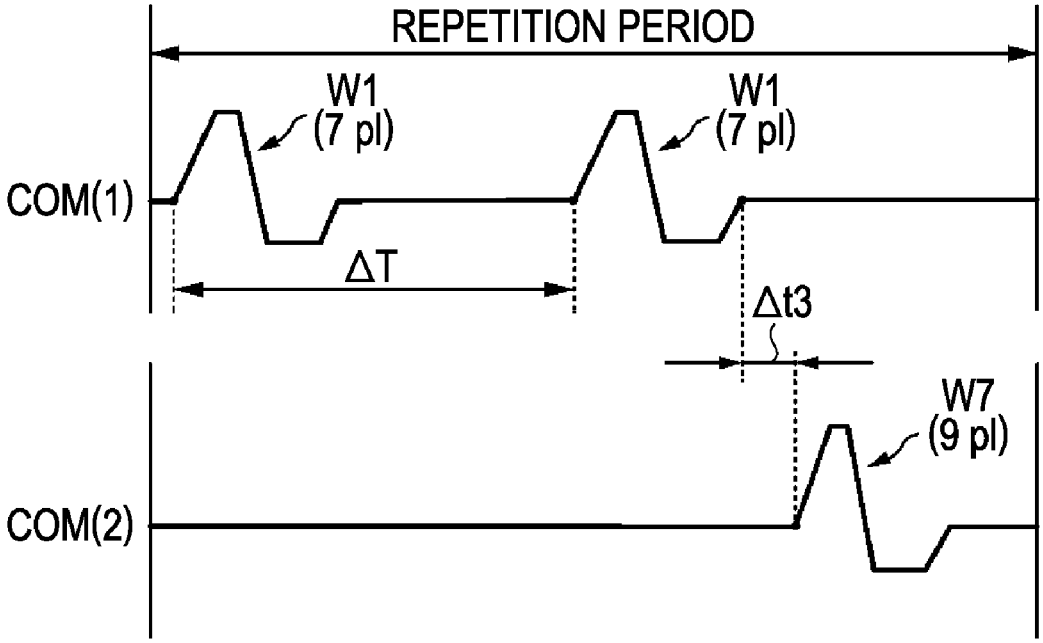
FIG. 15 is a diagram illustrating a driving signal according to a modified example.

FIG. 15 is a diagram illustrating the adjustment of the waveform interval Δt3 in the driving signal COM according to a modified example. The driving signal COM configured to generate the modified waveform W7 between the two basic waveforms W1 has been described as an example, but the invention is not limited thereto. As shown in FIG. 15, a driving signal COM may be used such that the modified waveform W7 is generated after the two basic waveforms W1. In this case, the ejection amount of ink is measured by varying the waveform interval Δt3 between the basic waveform W1 generated subsequently in the repetition period T1 and the modified waveform W7 a plural number of times. From the measurement result (the relationship between the waveform interval Δt3 and the ejection amount of ink), the waveform interval Δt3 may be determined at which the amount of ink ejected by the three driving waveforms W1 and W7 is the desired amount of ink (20 pl). In this case, the amount of ink ejected by the three driving waveforms W1 and W7 is adjusted by adjusting the amount of ink ejected by the modified waveform W7.

Like the above-described driving signal COM (see FIG. 10), when the modified waveform W7 is generated between the two basic waveforms W1, the length of the repetition period T can be shortened in a case where the number of kinds of driving waveforms W is small. That is, when the very large dot (14 pl) is formed by the two basic waveforms W1, a long generation interval ΔT between the two basic waveforms W1 is set to stabilize the meniscus after the ink ejection by the basic waveforms W1. Accordingly, by generating the modified waveform W7 between the two basic waveforms W1, the length of the repetition period T can be shortened.

Other Embodiments

In the above-described embodiment, a print system including the ink jet printer has mainly been described, but the disclosure regarding the driving signal or the like is also included. The above-described embodiment has been described for easy understanding of the invention and should not be construed as limiting the invention. The invention may be modified or improved without departing the gist of the invention and the equivalents are of course included in the invention. In particular, the following embodiments are also included in the invention.

Driving Waveform

In the above-described embodiment, the head 41 (see FIGS. 2A and 2B) has been used which includes the pressure chamber 412*d* expanding when the potential applied to the driving element increases and the pressure chamber 412*d* contracting when the potential applied to the driving element decreases. However, the invention is not limited thereto. For example, the pressure chamber may contract when the potential applied to the driving element increases. The pressure chamber may expand when the potential applied to the driving element decreases. In this case, a driving waveform formed by inverting the driving waveform W in FIG. 11 and FIGS. 12A and 12B may be used.

Line Printer

In the above-described embodiment, the printer 1 has been exemplified which alternately performs the image forming process of ejecting ink droplets while moving the head 41 in the moving direction and the transporting operation of transporting the medium. However, the invention is not limited thereto. For example, a line head printer may be used in which the plural nozzles are arranged in a direction intersecting the transporting direction of the medium and the head ejects ink droplets toward the medium transported below the head to form an image.

Liquid Ejecting Apparatus

In the above-described embodiment, the ink jet printer has been described as the liquid ejecting apparatus, but the invention is not limited thereto. The liquid ejecting apparatus is applicable to various industrial apparatuses, not to the printer (printing apparatus). For example, the invention is applicable to a printing apparatus attaching a shape to a cloth, a display manufacturing apparatus such as a color filter manufacturing apparatus or an organic EL display, a DNA chip manufacturing apparatus manufacturing a DNA chip by applying a solution, in which DNA is solved, to a chip, and the like. A fluid is not limited to the liquid, but a powder or the like may be used.

As a method of ejecting the fluid, a piezoelectric method may be used by ejecting the fluid by expanding and contracting an ink chamber may be used. A thermal method may be used by generating bubbles in nozzles by a heating element and ejecting a fluid by the bubbles.

What is claimed is:

1. A liquid ejecting apparatus comprising:

a driving element which is driven by a driving waveform;

a nozzle from which a liquid is ejected by driving the driving element;

a driving signal generator which creates a driving signal in which the driving waveform is generated; and a controller which permits the driving signal generator to generate two first driving waveforms and a second driving waveform in a predetermined period and to create the driving signal in which the two first driving waveforms and the second driving waveform are repeatedly generated in each predetermined period, wherein when the first driving waveform is applied to the driving element, a first amount of liquid is ejected from the nozzle, when the two first driving waveforms are applied to the driving element, a double of the first amount of liquid is ejected from the nozzle, when the second driving waveform is applied to the driving element, a second amount of liquid larger than the first amount of liquid and smaller than the double of the first amount of liquid is ejected from the nozzle, and when the two first driving waveforms and the second driving waveform are applied to the driving element, an amount of liquid smaller than a sum of the double of the first amount of liquid and the second amount of liquid is ejected from the nozzle.

* * * * *